US007190920B2

(12) United States Patent
Okamoto

(10) Patent No.: US 7,190,920 B2
(45) Date of Patent: Mar. 13, 2007

(54) DEVELOPING CARTRIDGE, AIR COMMUNICATION UNIT OF DEVELOPING CARTRIDGE AND TONER CARTRIDGE

(75) Inventor: Katsumi Okamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 210 days.

(21) Appl. No.: 10/508,118

(22) PCT Filed: Mar. 18, 2003

(86) PCT No.: PCT/JP03/03254

§ 371 (c)(1),
(2), (4) Date: Sep. 17, 2004

(87) PCT Pub. No.: WO03/079118

PCT Pub. Date: Sep. 25, 2003

(65) Prior Publication Data

US 2005/0141915 A1 Jun. 30, 2005

(30) Foreign Application Priority Data

Mar. 18, 2002 (JP) ..... 2002-074011
Aug. 29, 2002 (JP) ..... 2002-250098
Mar. 4, 2003 (JP) ..... 2003-057192

(51) Int. Cl.
*G03G 15/08* (2006.01)

(52) U.S. Cl. ..... 399/103; 399/107; 399/119; 399/227

(58) Field of Classification Search ..... 399/98, 399/102, 103, 107, 119, 120, 222, 227, 262; 222/DIG. 1
See application file for complete search history.

(56) References Cited

U.S. PATENT DOCUMENTS 5,381,217 A * 1/1995 Ishida ..... 399/120
5,832,343 A * 11/1998 Kobayashi et al. ..... 399/119
6,701,106 B2 * 3/2004 Yokoi et al. ..... 399/103
6,907,214 B2 * 6/2005 Kusano et al. ..... 399/262

FOREIGN PATENT DOCUMENTS

EP 0 893 743 A1 1/1999
JP 60-263972 A 12/1985
JP 04-298772 A 10/1992
JP 06-324568 11/1994
JP 9-424 U 7/1997
JP 2000-29296 A 1/2000
JP 2001-5365 A 1/2001
JP 2001-66888 A 3/2001
KR 1999-011671 A 2/1999

* cited by examiner

*Primary Examiner*—Hoan Tran
(74) *Attorney, Agent, or Firm*—Sughrue Mion, PLLC

(57) ABSTRACT

A developing cartridge 12 includes a housing 43 which has a peripheral surface and two end faces formed on both sides of the peripheral surface, and a toner containing space 45 which is formed in the housing and which contains toner 47 therein. A communication hole 61 is formed on a periphery surface of the developing cartridge 12. The communication hole 61 is sealed by a sticker 63 which has minute holes for allowing air to flow and preventing the toner 47 from passing through.

22 Claims, 19 Drawing Sheets

DEVELOPING CARTRIDGE, AIR COMMUNICATION UNIT OF DEVELOPING CARTRIDGE AND TONER CARTRIDGE

TECHNICAL FIELD

This invention relates to a developing cartridge used with a laser printer for storing toner and developing a latent image formed on a photoconductor drum in the toner and in particular to a structure for adjusting the pressure in a housing of a developing cartridge attached to a rotary developing unit for use.

BACKGROUND ART

In a laser printer including a rotary developing unit, a plurality of developing cartridges storing different color toners are set in the rotary developing unit. At the printing time, while the rotary developing unit is rotated, the developing cartridge storing the necessary color toner is brought adjacent to a photoconductor drum, and the toner is supported on a latent image formed on the photoconductor drum and is transferred from the photoconductor drum via a transfer belt to a sheet for fixation.

Since the toner stored in the developing cartridge is consumed gradually, a negative pressure may be developed in the developing cartridge because of a decrease in the volume occupied by the toner. In contrast, it is also possible that the pressure in the sealed developing cartridge may rise because of the effect of heat from a heating element positioned in the proximity of the developing cartridge. If the difference between the pressure in the developing cartridge and the atmospheric pressure is thus produced, the toner supply state from the developing cartridge may worsen or toner may be supplied more than necessary from the developing cartridge, degrading the quality of the image of printed matter.

Hitherto, an air hole is formed on an end face of the housing of a developing cartridge. The air hole is sealed by a seal member for preventing toner from flowing out, but allowing air to flow to put for making the pressure in the developing cartridge equal to the atmospheric pressure, as disclosed in Patent document 1.

[Patent Document 1]

JP-A-6-324568

However, pressure adjustment according to the structure wherein the housing is formed on the end face with an air hole as in the related art is attributed only to natural air communication caused by the difference between the pressure in the housing and the atmospheric pressure. Therefore, it takes some time until complete pressure adjustment is made. If the pressure in the developing cartridge rises accompanying a rapid temperature rise, there is also a possibility that a detrimental effect of excessive outflow of toner, etc., may be caused to occur before the pressure in the developing cartridge lowers.

DISCLOSURE OF THE INVENTION

It is therefore an object of the invention to provide a developing cartridge, an air communication unit of the developing cartridge, and a toner cartridge, using the fact that a rotary developing unit rotates on a rotation shaft to make it possible to forcibly discharge air in a developing cartridge or forcibly suck the outside air for promptly adjusting the pressure in the developing cartridge.

To achieve the above object, according to a first aspect of the invention, there is provided a developing cartridge, comprising: a housing, which has a peripheral surface and two end faces formed on both sides of the peripheral surface, a toner containing space surrounded by the peripheral surface and two end faces which contains toner therein, and the housing having a communication hole which communicates the toner containing space with an exterior; and a sticker, which is arranged so as to seal the communication hole. The sticker has minute holes for allowing air to flow and preventing the toner from passing through.

According to the invention, the rotary developing unit rotates, whereby the toner in the housing drops in a stroke, so that the air below the toner at the time is pushed out in a stroke through the communication holes formed in the lower side of the peripheral surface of the housing and on the other hand, the outside air can be forcibly sucked into the space occupied by the toner through the communication holes formed in the upper side of the peripheral surface of the housing.

As the developing cartridge according to a second aspect of the invention, in the first aspect of the invention, the peripheral surface of the housing has an upper face and a lower face. The communication hole is formed in either or both of the upper face and the lower face.

Air is pulled in through the communication hole formed in the upper face of the peripheral surface of the housing in the beginning and air is pushed out through the communication hole formed in the lower face. Then, when the rotary developing unit rotates 180 degrees, the communication holes formed in the upper and lower faces function in opposite manner. Thus, whenever the rotary developing unit rotates, air is discharged and sucked alternately through the same communication hole with a move of toner, so that rapid pressure adjustment in the housing is made.

As the developing cartridge according to a third aspect of the invention, in the first or second aspect of the invention, the developing cartridge further including a developing roller which provides the toner in the toner containing space to the conductor drum, the developing roller having a rotation shaft to be rotatably attached to the housing; and an abutment regulation roller, which regulates a distance between the developing roller and the conductor drum, and the abutment regulation roller attached to both ends of the rotation shaft of the developing roller. The communication hole is formed in the vicinity of the abutment regulation roller.

According to the invention, the toner drops in a stroke due to the vibration produced when the abutment regulation roller collides with the peripheral surface of the photoconductor drum, so that the discharging effect of the air in the housing and the suction effect of the outside air into the housing are enhanced.

As the developing cartridge according to a fourth aspect of the invention, in the third aspect of the invention, the communication hole is formed so as to correspond a position of the abutment regulation roller.

According to the invention, the vibration produced when the abutment regulation roller collides with the peripheral surface of the photoconductor drum propagates directly to the housing, so that the discharging effect of the air in the housing and the suction effect of the outside air into the housing are still more enhanced.

As the developing cartridge according to a fifth aspect of the invention, in the third or fourth aspect of the invention, the communication hole is constituted by a plurality of communication holes. One of the communication holes is formed at a center portion of the housing.

According to the invention, the discharging effect of air and the suction effect of the outside air into the housing in the vicinity of the center portion of the housing are provided, so that the discharging effect of air and the suction effect of the outside air in the whole housing are enhanced.

As the developing cartridge according to a sixth aspect of the invention, in the first aspect of the invention, the communication hole is constituted by a plurality of small holes. According to the invention, the discharging effect of air and the suction effect of the outside air can be more averaged.

As the developing cartridge according to a seventh aspect of the invention, in the first aspect of the invention, the developing cartridge further including a label, which is put on the sticker. The label is formed with an air hole for allowing air to flow.

According to the invention, the presence of the communication hole can be hidden by the label. On the other hand, the label is formed with the air hole and thus the discharging effect of air and the suction effect of the outside air remain unchanged.

As the developing cartridge according to an eighth aspect of the invention, in the first aspect of the invention, the developing cartridge including a label which is put on the housing so as to have a gap between the label and the sticker. A communication passage which communicates the gap to an atmosphere is formed.

According to the invention, even if a label not formed with an air hole for allowing air to flow is used, the label does not block the minute holes of the sticker and the discharging effect of air and the suction effect can be provided.

As the developing cartridge according to a ninth aspect of the invention, in the eighth aspect of the invention, the communication hole is provided on a bottom of a depression formed on the peripheral surface of the housing.

According to the invention, the depression is formed on the surface of the housing and the communication hole is provided on the bottom of the depression, so that a gap can be easily provided between the sticker and the label. That is, the gap between the sticker and the label can be provided simply by putting the label on the housing so as to cover the indentation. Therefore, the gap between the sticker and the label can be formed without projecting the contours of the housing.

As the developing cartridge according to a tenth aspect of the invention, in the ninth aspect of the invention, the communication passage is a groove formed on the peripheral surface of the housing. The groove is formed so as to extend to a side face of the depression.

According to the invention, the groove is formed on the surface of the housing for use as the communication passage, so that the communication passage can be formed without projecting the contours of the housing. Therefore, the contours of the housing can be shaped almost like those of the housing in the related art, and the gap and the communication passage can be provided without upsizing the developing cartridge more than necessary.

As the developing cartridge according to an eleventh aspect of the invention, in the tenth aspect of the invention, the groove is formed so as to extend to an end face of the housing.

According to the invention, the groove used as the communication passage is formed so as to extend to the end face of the housing from the side face of the depression, so that the depression and the groove formed on the peripheral surface of the housing can be covered with the label, and it is made possible to hide the depression and the groove from the label indication face.

As the developing cartridge according to a twelfth aspect of the invention, in the ninth aspect of the invention, the communication passage is constituted by a cut part formed on the periphery of the label and a side face of the depression.

According to the invention, the housing need not be formed in the surface with any groove, etc., as the communication passage, so that the adhesive surface of the label becomes uniform. That is, an uneven portion of a groove, etc., need not be formed in the margin of the depression to bond the label and the adhesive surface of the label can be made uniform without bonding the label to an uneven portion and by extension the label can be prevented from peeling off.

As the developing cartridge according to a thirteenth aspect of the invention, in the eighth aspect of the invention, the developing cartridge further includes gap securing means which secures the gap between the sticker and the label.

According to the invention, the sticker and the label can be prevented from coming in intimate contact with each other or bonding together for blocking the communication passage to allow the gap and the atmosphere to communicate with each other.

As the developing cartridge according to a fourteenth aspect of the invention, in the thirteenth aspect of the invention, the gap securing means is so configured that the back of the label opposed to the sticker is not provided with an adhesive.

According to the invention, no adhesive exists on the back of the label, the opposed portion to the sticker, namely, the portion has no adhesive force, so that the label can be prevented from bonding to the sticker.

As the developing cartridge according to a fifteenth aspect of the invention, in the thirteenth aspect of the invention, the back of the label is fully provided with an adhesive and the gap securing means is so configured that the back of the label opposed to the sticker is provided with adhesion prevention means.

According to the invention, the adhesion prevention means having no adhesion, such as paper, a cloth, or a plastic sheet, exists on the back of the label, thereby preventing the label from bonding to the sticker.

As the developing cartridge according to a sixteenth aspect of the invention, in the fifteenth aspect of the invention, the adhesion prevention means is a release sheet put on the back of the label.

According to the invention, only the position opposed to the sticker, of the original release sheet put on the back of the label is left, whereby bonding of the label to the sticker with the adhesive existing on the back of the label can be prevented.

As the developing cartridge according to a seventeenth aspect of the invention, in the sixteenth aspect of the invention, the release sheet is formed with a drop prevention portion projected from an outer periphery of the release sheet. The drop prevention portion is sandwiched between the label and the surface of the housing.

According to the invention, the adhesive of the label adheres to the surface of the housing on both sides of the drop prevention portion and thus the drop prevention portion is sandwiched between the label and the surface of the housing. Accordingly, the release paper can be prevented from peeling off and dropping from the back of the label As the developing cartridge according to an eighteenth aspect of the invention, in the sixteenth aspect of the invention, the release sheet has one side to which a release agent is applied and an opposite side to which no release agent is applied, the release paper is peeled off and is turned inside out, and the side of the release paper to which no release agent is applied is again put on the position where the release paper was provided in the beginning, whereby the adhesion prevention means can be formed.

According to the invention, the side of the release paper to which no release agent is applied is put on the adhesive face of the label, so that the release sheet does not drop from the label and can function as the adhesion prevention means.

As the air communication unit of the developing cartridge according to an nineteenth aspect of the invention, an air communication unit of a developing cartridge used with a rotary developing unit for rotating around a rotation shaft with a plurality of developing cartridges placed therein, thereby bringing the selected developing cartridge adjacent to a photoconductor drum in an image formation apparatus and moving toner in the developing cartridge to the photoconductor drum, the developing cartridge which includes: a housing, which has a peripheral surface and two end faces of both sides of the peripheral surface; and a toner storage portion, which is formed in the housing for storing toner. A communication hole is formed in the peripheral surface. The communication hole is sealed by a sticker which has minute holes for allowing air to flow and preventing the toner from passing through.

According to the invention, the rotary developing unit rotates, whereby the toner in the housing drops in a stroke, so that the air below the toner at the time is pushed out in a stroke through the communication holes formed in the lower side of the peripheral surface of the housing and on the other hand, the outside air can be forcibly sucked into the space occupied by the toner through the communication holes formed in the upper side of the peripheral surface of the housing.

As the air communication unit of the developing cartridge according to a twentieth aspect of the invention, in the nineteenth aspect of the invention, a label is put on the sticker. The label is formed with an air hole for allowing air to flow.

According to the invention, the presence of the communication hole can be hidden by the label. On the other hand, the label is formed with the air hole and thus the discharging effect of air and the suction effect of the outside air remain unchanged.

As the air communication unit of the developing cartridge according to claim 21, a label is put on the housing so as to have a gap between the label and the sticker. A communication passage which communicates the gap to an atmosphere is formed.

According to the invention, even if a label not formed with an air hole for allowing air to flow is used, the label does not block the minute holes of the sticker and the discharging effect of air and the suction effect can be provided.

As the air communication unit of the developing cartridge according to a twenty-second aspect of the invention, in the twentieth aspect of the invention, the air communication unit of the developing cartridge which further includes gap securing means which secures the gap between the sticker and the label.

According to the invention, the sticker and the label can be prevented from coming in intimate contact with each other or bonding together for blocking the communication passage to allow the gap and the atmosphere to communicate with each other.

As the toner cartridge according to a twenty-third aspect of the invention, a toner cartridge which includes a housing, which has a peripheral surface and two end faces formed on both sides of the peripheral surface, a toner containing space surrounded by the peripheral surface and two end faces which contains toner therein, and the housing having a communication hole which communicates the toner containing space with an exterior; and a sticker, which is arranged so as to seal the communication hole. The sticker has minute holes for allowing air to flow and preventing the toner from passing through.

According to the invention, even if the toner cartridge having no member such as a developing roller or having the member in separately, the effect same as the effect described in the first aspect can be obtained. In other words, according to the invention, the rotary developing unit rotates, whereby the toner in the housing drops in a stroke, so that the air below the toner at the time is pushed out in a stroke through the communication holes formed in the lower side of the peripheral surface of the housing and on the other hand, the outside air can be forcibly sucked into the space occupied by the toner through the communication holes formed in the upper side of the peripheral surface of the housing.

As the toner cartridge according to a twenty-fourth aspect of the invention, in the twenty-third aspect of the invention, the peripheral surface of the housing has an upper face and a lower face. The communication hole is formed in either or both of the upper face and the lower face.

According to the invention, even if the toner cartridge having no member such as a developing roller or having the member in separately, the effect same as the effect described in the first aspect can be obtained. In other words, according to the invention, the presence of the communication hole can be hidden by the label. On the other hand, the label is formed with the air hole and thus the discharging effect of air and the suction effect of the outside air remain unchanged.

BRIEF DESCRIPTION OF THE DRAWING

FIG. 8(*b*) is an enlarged view of the left portion of the roller support frame;

and FIG. 8(*c*) is a sectional side view to show the surroundings of a roller end seal member and the roller support frame.

BEST MODE FOR CARRYING OUT THE INVENTION

Figure 1:
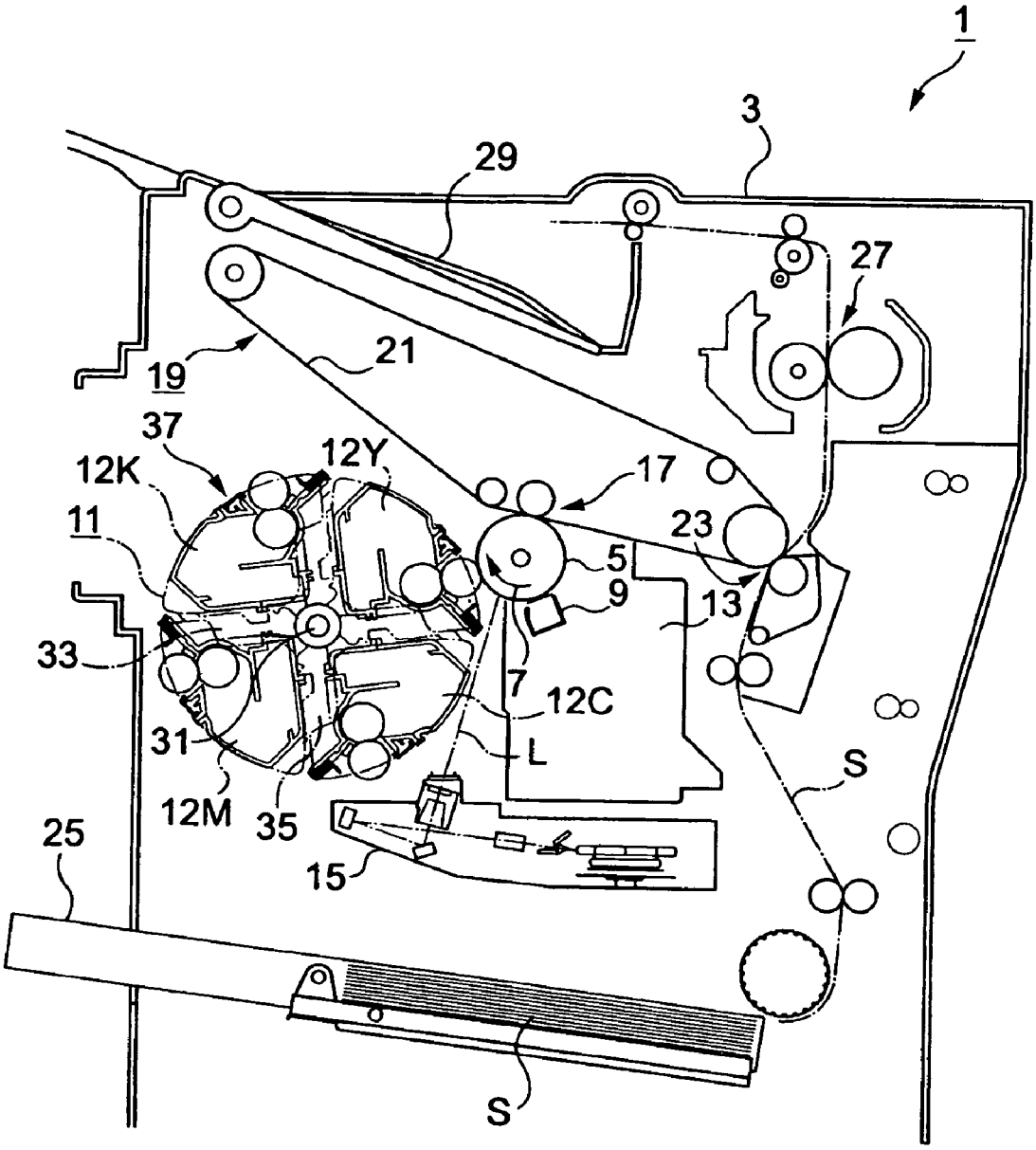
FIG. 1 is a sectional side view to show an image formation apparatus including developing cartridges each having an air communication unit according to the invention.

Referring now to the accompanying drawings, there are shown preferred embodiments of the invention. FIG. 1 is a sectional side view to show an image formation apparatus 1 including developing cartridges each having an air communication unit according to the invention. In the image formation apparatus 1, a photoconductor drum 5 is provided in an apparatus main unit 3 for rotation in the direction of an arrow 7 a charger 9 of charging means, a rotary developing unit 11 for holding developing cartridges of developing means, and a cleaning member 13 are provided around the photoconductor drum 5 in the rotation direction 7. A charge bias is applied to the charger 9 from a charge bias circuit (not shown) and the charger 9 can uniformly charge the outer peripheral surface of the photoconductor drum 5.

A light exposure unit 15 is provided below the rotary developing unit 11 and laser light L is applied from the light exposure unit 15 to the outer peripheral surface of the photoconductor drum 5 charged by the charger 9. The light exposure unit 15 scans laser light L over the photoconductor drum 5 in response to the image data provided by expanding an image formation command into an image, thereby forming an electrostatic latent image corresponding to the image formation command on the photoconductor drum 5.

The electrostatic latent image thus formed is developed in toner by the rotary developing unit 11. That is, the embodiment, the rotary developing unit 11 is provided with a yellow developing cartridge 12Y, a cyan developing cartridge 12C, a magenta developing cartridge 12M, and a black developing cartridge 12K for rotation on a rotation shaft 31 of the rotary developing unit 11. As the circumferential positions of the developing cartridges 12Y, 12C, 12M, and 12K are determined, the developing cartridges 12Y, 12C, 12M, and 12K can be selectively brought adjacent to the photoconductor drum 5 for supplying toner to the surface of the photoconductor drum 5. Accordingly, the electrostatic latent image on the photoconductor drum 5 is rendered visible in the selected toner color. FIG. 1 shows the state in which the yellow developing cartridge 12Y supplies toner to the photoconductor drum 5. To describe "top, upper, above, etc.," or "bottom, lower, below, etc.," with respect to the developing cartridges, the orientation of the yellow developing cartridge 12Y in FIG. 1 is used as the reference.

A transfer unit 19 is provided above the space from the rotary developing unit 11 to the cleaning member 13. The transfer unit 19 includes an intermediate transfer belt 21 placed on a plurality of rollers and a drive member (not shown) for rotating the intermediate transfer belt 21. A toner image developed by the rotary developing unit 11 is primary-transferred onto the intermediate transfer belt 21 of the transfer unit 19 in a primary transfer area 17. The toner remaining and deposited on the outer peripheral surface of the photoconductor drum 5 after the primary transfer is scratched by the cleaning member 13 at the rotation position in the rotation direction indicated by the arrow 7 in FIG. 1 from the primary transfer area 17.

To transfer a color image to a sheet member S, the color toner images formed on the photoconductor drum 5 are superimposed on the intermediate transfer belt 21 to form a color image and the color image is secondary-transferred onto the sheet member S taken out from a cassette 25 in a secondary transfer area 23. The sheet member S with the color image thus formed thereon is passed through a fuser unit 27 and is transferred to an ejection tray section 29 provided on the top face of the apparatus main unit 3.

Figure 2:
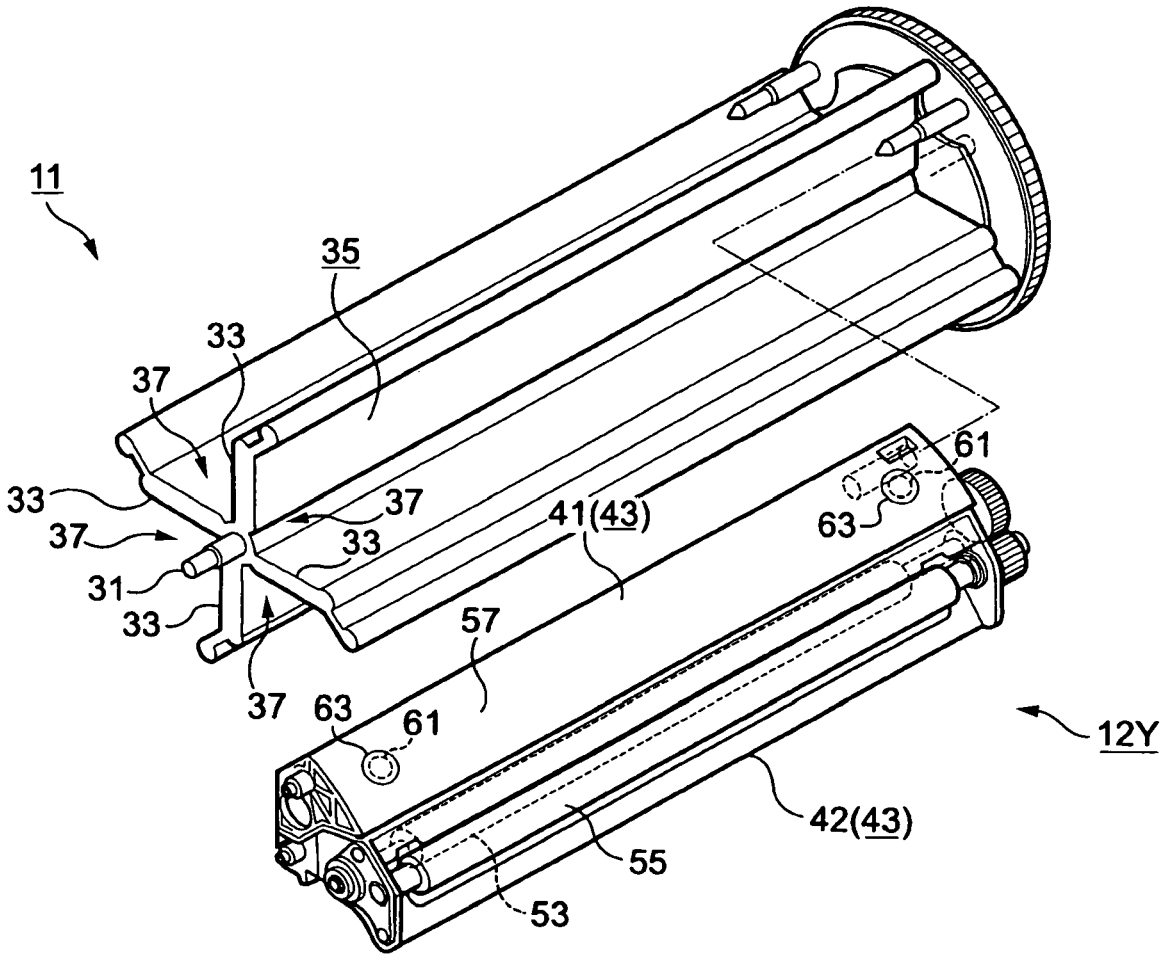
FIG. 2 is a perspective view of a rotary developing unit according to the invention.

Next, the configuration and the operation of the rotary developing unit 11 included in the image formation apparatus 1 in FIG. 1 will be discussed. FIG. 2 is a perspective view of the rotary developing unit 11. As shown in FIG. 2, the rotary developing unit 11 has the rotation shaft 31 at the center and a support frame 35, made up of four frame elements 33 which are provided around the rotation shaft 31 and formed at 90-degree intervals, is fixed to the rotation shaft 31. A storage section 37 is provided between the frame elements 33. The four color developing cartridges 12Y, 12C, 12M, and 12K are stored in the storage sections 37 and are fixed to the support frame 33 by metal fittings (not shown). In FIG. 2, only the developing cartridge 12Y is shown for simplicity.

A drive member (not shown) is connected to the rotation shaft 31 through a clutch. As the drive member is driven, the support frame 35 can be rotated for selectively positioning any one of the four developing cartridges 12Y, 12C, 12M, 12K at the developing position opposed to the photoconductor drum 5 (in FIG. 1, the position of the developing cartridge 12Y).

The developing cartridges 12Y, 12C, 12M, and 12K held on the support frame 35 have the same configuration.

Therefore, in the description that follows, the developing cartridges 12Y, 12C, 12M, and 12K are collectively called the developing cartridge 12.

Figure 3:
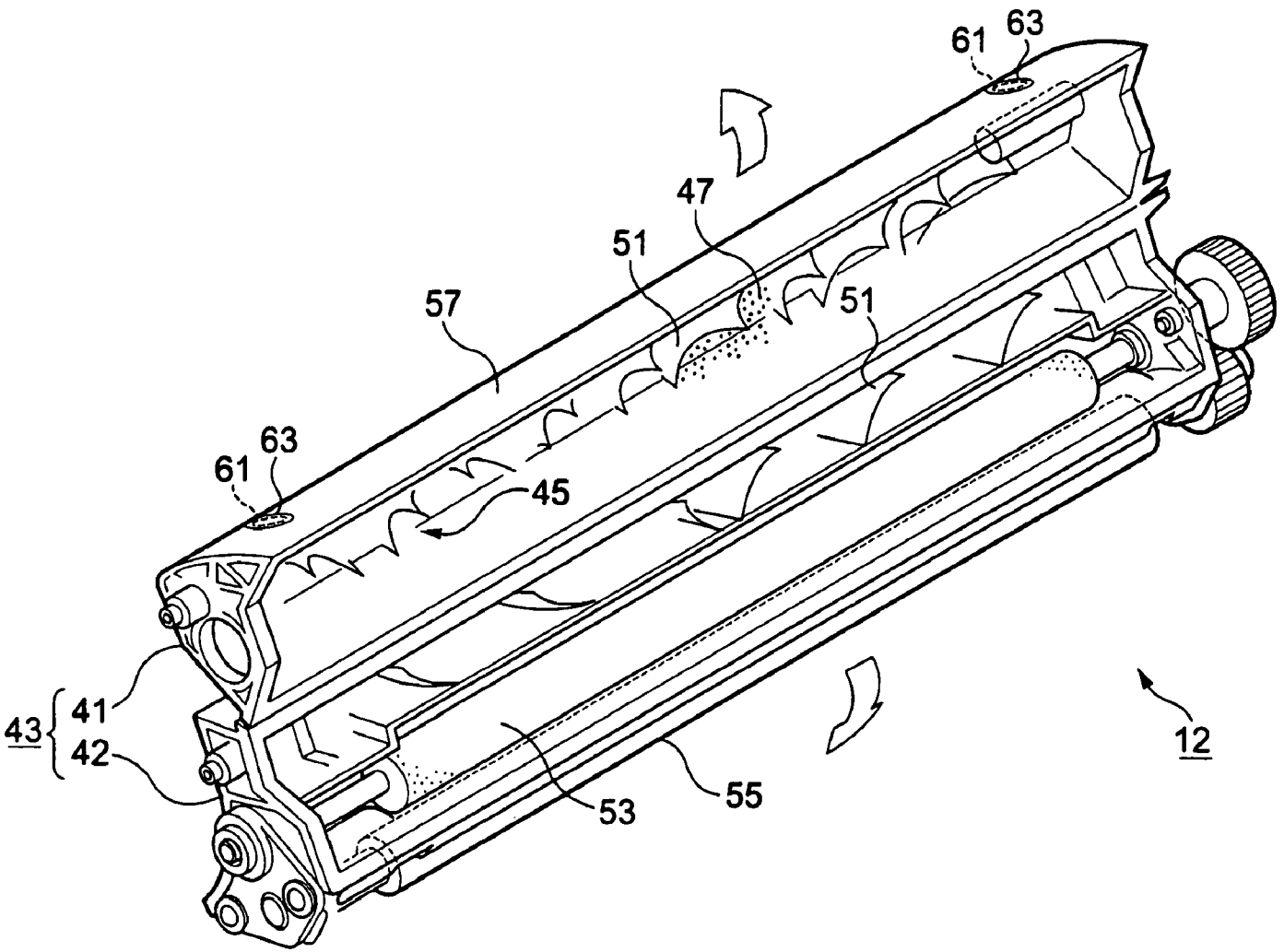
FIG. 3 is a perspective view to show the developing cartridge in a state in which an upper housing member and a lower housing member are opened in arrow directions according to the invention.

The developing cartridge 12 has an upper housing member 41 and a lower housing member 42 combined in one piece to form a housing 43 as the main body. FIG. 3 shows a state in which the upper housing member 41 and the lower housing member 42 are opened in the arrow directions.

A toner storage portion 45 for storing toner is formed in the housing 43 and is formed with a plurality of inclined agitation pieces 51 for agitating toner 47. When the rotary developing unit 11 rotates on the rotation shaft 31, the toner 47 drops along the agitation pieces 51 and thus is agitated in the toner storage portion 45.

Figure 4:
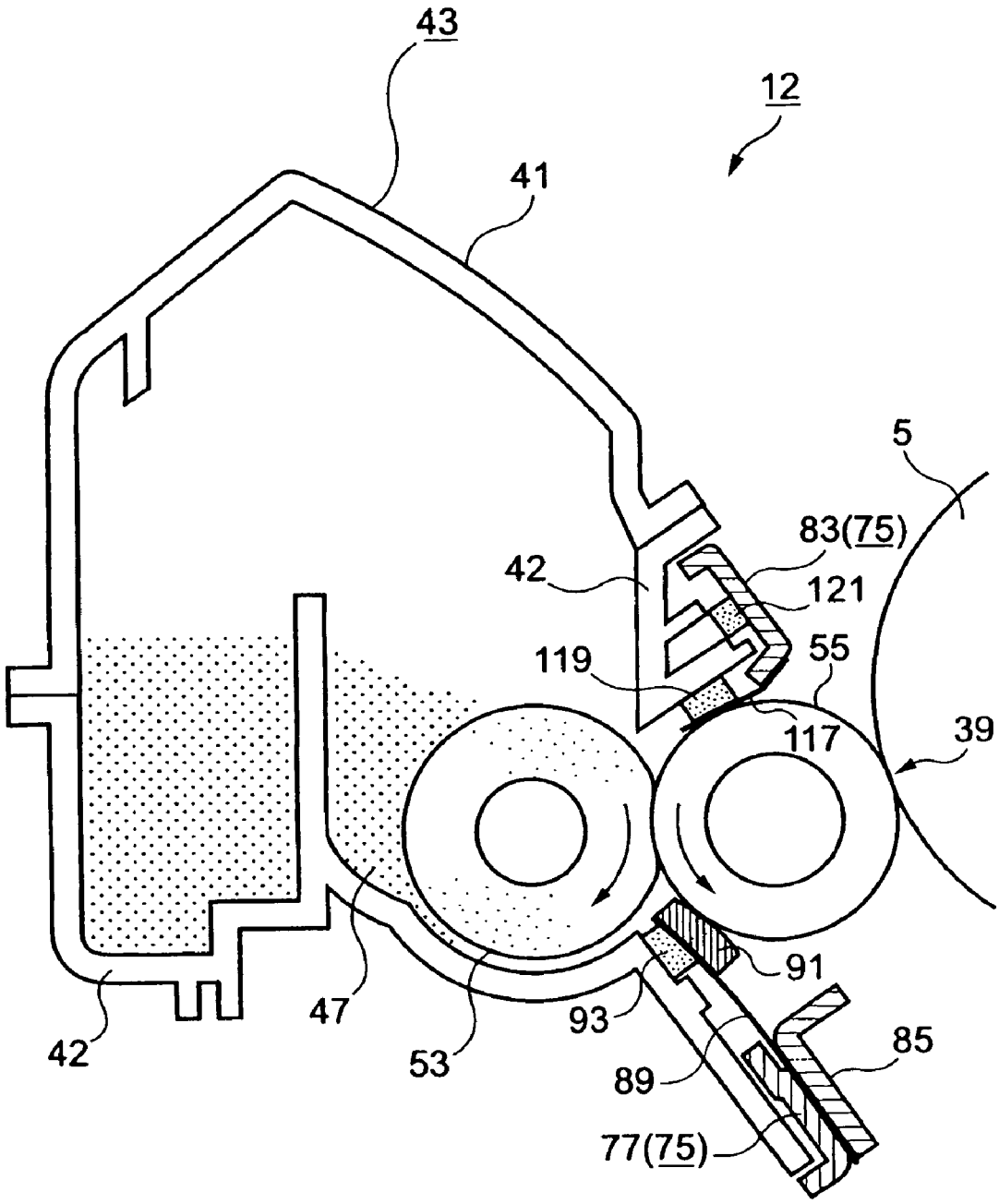
FIG. 4 is a sectional side view of the developing cartridge according to the invention.

A supply roller 53 (also called S roller) having a surface formed of a urethane sponge is placed in the toner storage portion 45 for rotation. As shown in FIGS. 3 and 4, a developing roller 55 (also called D roller) is placed on the outside of the supply roller 53 in a state in which the developing roller 55 is in contact with the supply roller 53. When the supply roller 53 rotates in the arrow direction in a state in which the toner 47 stored in the housing 43 is supported on the surface of the supply roller 53, the developing roller 55 rotates in the arrow direction in FIG. 4 at lower speed than the supply roller 53 while receiving the toner 47 on the outer peripheral surface of the developing roller 55 from the supply roller 53. In the example, the supply roller 53 rotates at the speed 1.5 times that of the developing roller 55.

The developing roller 55 rotates while coming in contact with the photoconductor drum 5, and the toner 47 supported on the developing roller 55 is deposited on the surface of the photoconductor drum 5 at a developing position 39. Thus, the toner 47 from the supply roller 53 is rubbed against the surface of the developing roller 55 to form a toner layer of a predetermined thickness (for example, about 10 μm to 20 μm), and this toner layer is moved to the photoconductor drum 5 in a similar manner.

Figure 5:
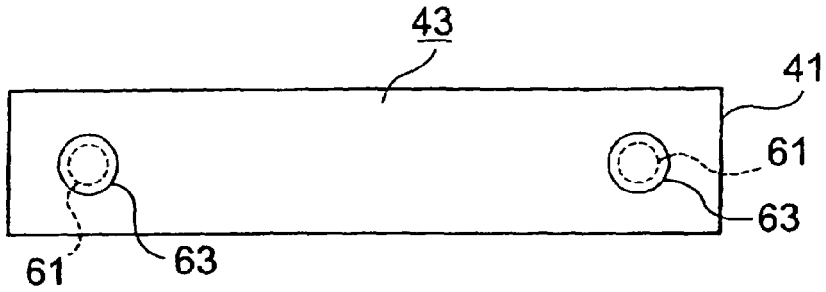
FIGS. 5(*a*) to 5(*d*) are front views to show four embodiments of through holes formed in the housing.
Figure 5:
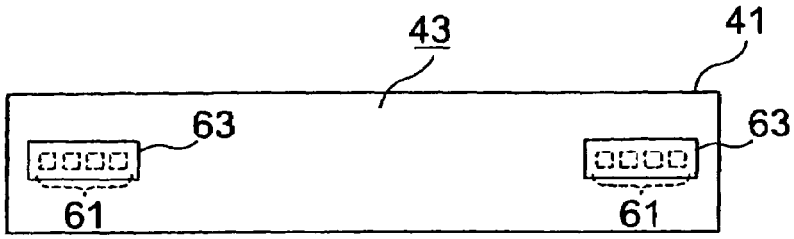
Figure 5:
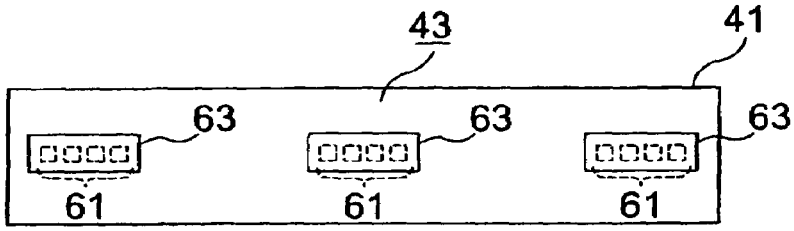
Figure 5:
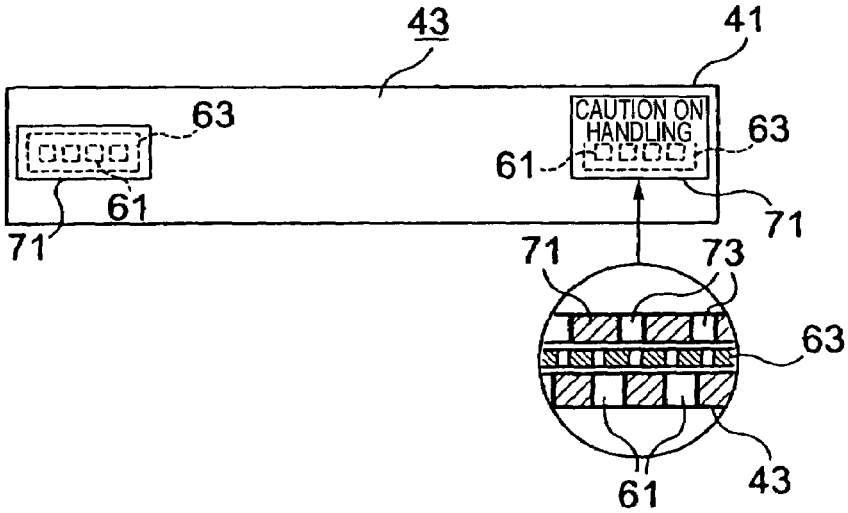

As shown in FIG. 2 and FIG. 5(*a*), the upper housing member 41 forming a part of the housing 43 is formed in a top face 57 with communication holes 61 to allow air in the toner storage portion 45 to communicate with the atmospheric pressure. A sticker 63 formed with a large number of minute holes each of the size to allow air to pass through and prevent toner from passing through is put on each of the communication holes 61. As the air communication means communicated with the inside of the toner storage portion 45 is provided on the top face 57 of the upper housing member 41, when the rotary developing unit 11 rotates on the rotation shaft 31, the toner 47 drops, thereby pushing out the air below the toner through the communication holes 61, so that the air in the toner storage portion 45 can be interchanged.

Figure 6:
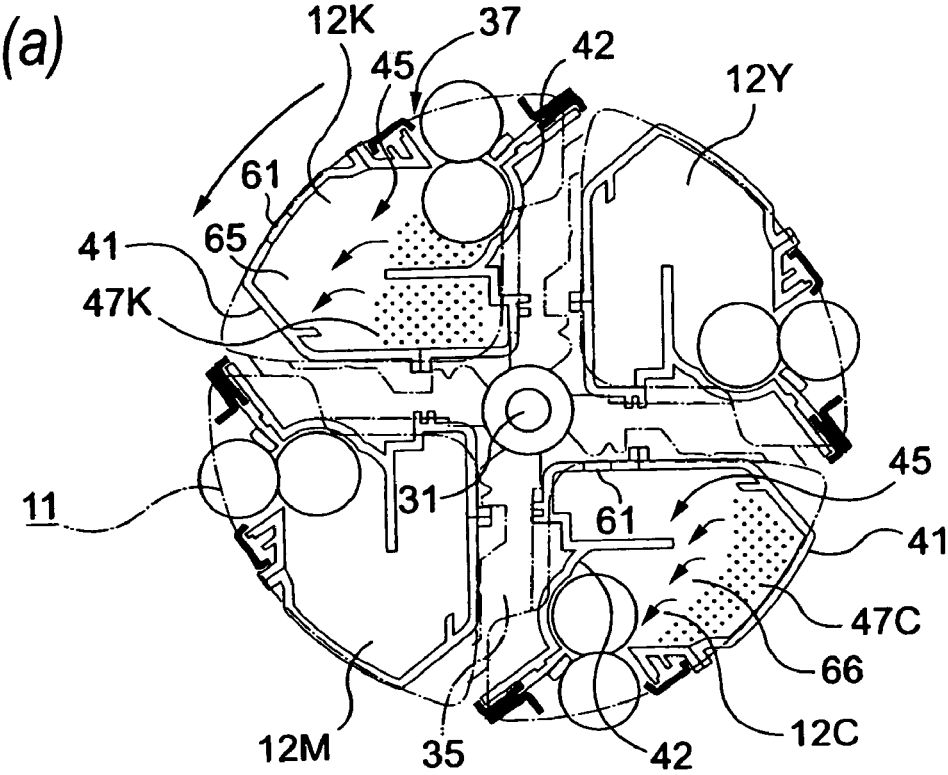
FIGS. 6(*a*) and 6(*b*) are drawings to show motion of toner in each of the developing cartridges 12C and 12K when the rotary developing unit rotates from the state shown in FIG. 6(*a*) to the state shown in FIG. 6(*b*) with attention focused on the developing cartridges according to the invention.
Figure 6:
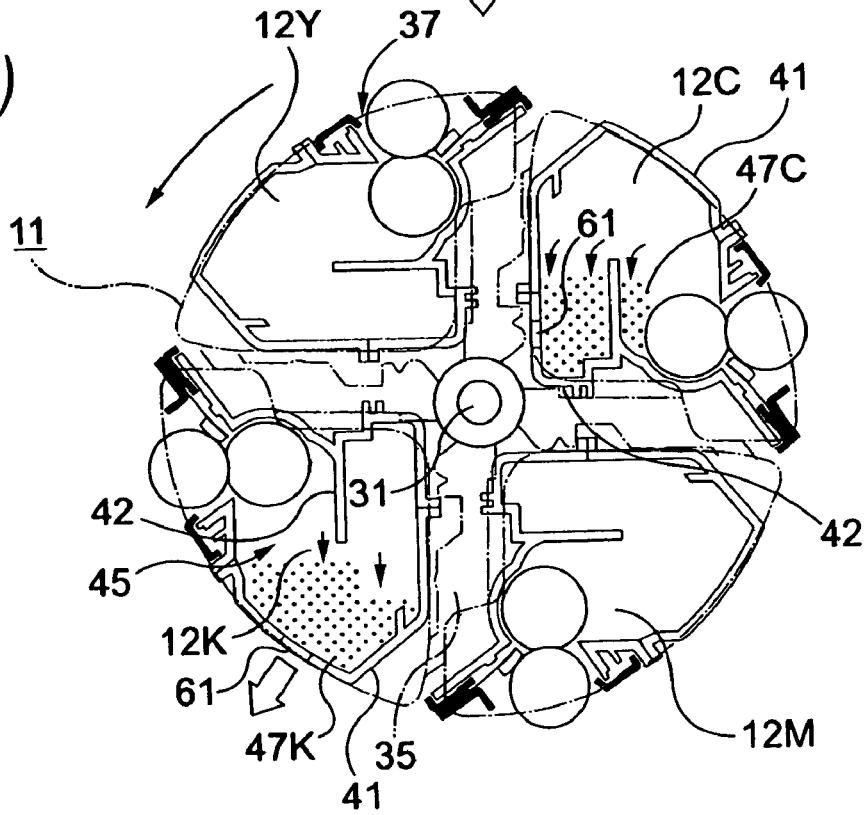

FIGS. 6(*a*) and 6(*b*) are drawings to show motion of the toner 47 in each of the developing cartridges 12C and 12K when the rotary developing unit 11 rotates from the state shown in FIG. 6(*a*) to the state shown in FIG. 6(*b*) with attention focused on the developing cartridges 12C and 12K. The sticker 63 is not shown in FIGS. 6(*a*) and 6(*b*).

In FIG. 6(*a*), toner 47K in the developing cartridge 12K is positioned in the lower housing member 42 and then when the rotary developing unit 11 rotates to the position shown in FIG. 6(*b*), the toner 47K in the developing cartridge 12K drops and moves to the upper housing member 41. At this time, air in an area 65 of space in the toner storage portion 45 is expelled from the toner storage portion 45 through the communication holes 61 by the toner 47K dropping so as to cover from the upper side.

The structure of putting the sticker 63 on the communication hole 61 may be formed on the lower housing member 42. The structure of forming the communication holes 61 in the lower housing member 42 is shown in the developing cartridge 12C. The communication holes 61 may be formed in both the upper housing member 41 and the lower housing member 42 of one developing cartridge 12.

To form the communication holes 61 in the lower housing member 42, when the rotary developing unit 11 rotates from the state in which toner 47C in the developing cartridge 12C is positioned in the upper housing member 41 as shown in FIG. 6(*a*) to the position shown in FIG. 6(*b*), the toner 47C in the developing cartridge 12C drops and moves to the lower housing member 42. At this time, air in an area 66 of space in the toner storage portion 45 is expelled through the communication holes 61 formed in the lower housing member 42 by the toner 47C dropping so as to cover from the upper side.

As the air in the toner storage portion 45 is thus allowed to circulate freely through the communication holes 61, a negative pressure is not developed in the toner storage portion 45 in the process in which the toner 47 in the toner storage portion 45 is consumed, making it possible to maintain the pressure in the toner storage portion 45 always equal to the atmospheric pressure. If a heat generation source exists in the proximity of the toner storage portion 45, the air in the toner storage portion 45 can be prevented from being expanded and becoming a pressurization state by heat from the heat generation source. Therefore, the effect of the pressure in the toner storage portion 45 can be excluded and the toner supply state from the toner storage portion 45 can be always kept constant.

The communication hole 61 with the sticker 63 put thereon as described above needs to be formed at such a position to be able to push out or in contrast absorb the air in the housing 43, namely, "breathe" with motion of the toner 47 as the rotary developing unit 11 rotates. The air communication unit of the invention is effective particularly for a developing cartridge having no agitator. In the developing cartridge including the air communication unit of the invention, the toner 47 is agitated by rotation of the rotary developing unit 11 for properly using the four color toners, by rotation of the rotary developing unit 11 intended only for agitating the toner after the termination of print, and by rotation of the rotary developing unit 11 intended only for agitating the toner when the image formation apparatus has stopped for a long time. At the time, as air circulates through the communication holes 61, motion of the toner in the housing is promoted and the agitation efficiency can be enhanced accordingly.

The communication hole 61 may be formed at any position in the upper housing member 41 or the lower housing member 42 if it is a portion having a breath function as mentioned above; preferably the communication holes 61 are formed in the vicinity of both ends of the upper housing member 41 or the lower housing member 42. The reason will be discussed with reference to FIG. 7.

Figure 7:
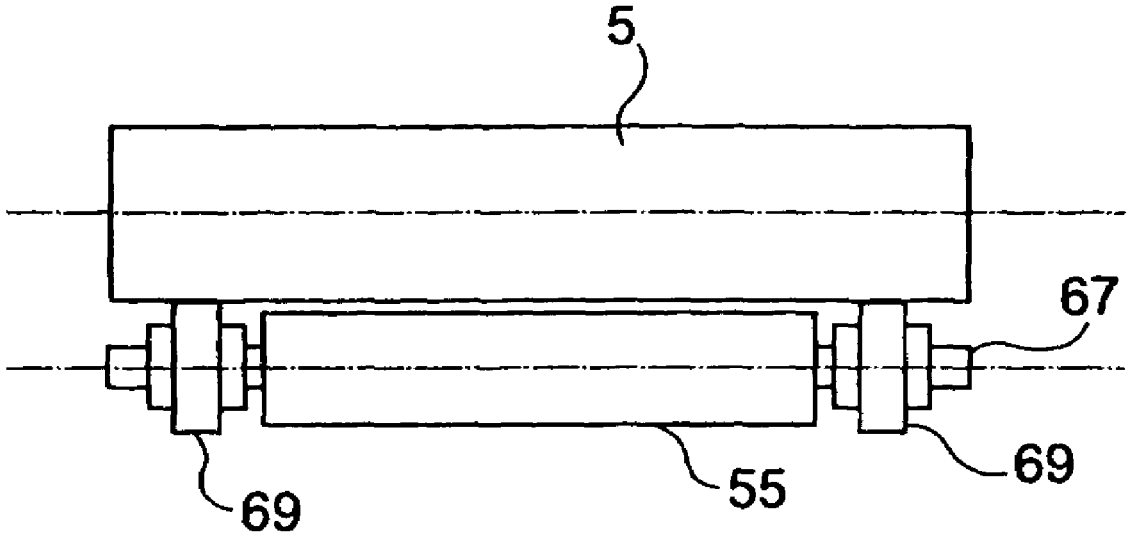
FIG. 7 is a side view to show a state in which abutment regulation rollers provided on a developing roller of the developing cartridge collide with a photoconductor drum according to the invention.

As shown in FIG. 7, the developing roller 55 is attached to a rotation shaft 67 and an abutment regulation roller 69 having a diameter a little larger than that of the developing roller 55 is provided at both ends of the rotation shaft 67 for rotation. In FIG. 1, when the rotary developing unit 11 rotates and the yellow developing cartridge 12Y, for example, approaches the photoconductor drum 5, the peripheral surfaces of the two abutment regulation rollers 69 of the developing cartridge 12Y collide lightly with the photoconductor drum 5, defining the distance between the peripheral surface of the developing roller 55 and that of the photoconductor drum 5 as a predetermined distance. The predetermined distance is drawn comparatively large in FIG. 7, but actually is an extremely small distance of 1 mm or less.

The vibration produced when the peripheral surfaces of the abutment regulation rollers 69 collide with the photoconductor drum 5 easily propagates particularly to the vicinity of both ends of the housing 43 in the proximity of the abutment regulation rollers and thus the toner 47 in the vicinity of both ends of the housing 43 easily drops in a stroke due to the vibration. Thus, preferably the communication holes 61 are formed in the vicinity of both ends of the upper housing member 41 or the lower housing member 42, particularly at the positions corresponding to the positions of the two abutment regulation rollers 69.

As the communication holes 61, a comparatively large hole may be formed in each of both ends of the housing 43 as shown in FIG. 5(*a*); a group of four (or any number of) small holes in place of a large hole may be formed in each of both ends of the housing 43 as shown in FIG. 5(*b*); or a plurality of small holes may be formed not only in both ends of the housing 43, but also in the center of the housing 43 as shown in FIG. 5(*c*). The sticker 63 having minute holes is put on every small hole, as described above.

A label 71 describing caution on handling, etc., for example, may be put on the sticker 63 having minute holes put on the communication hole 61, as shown in FIG. 5(*d*). As shown in a sectional view on an enlarged scale in FIG. 5(*d*), the label 71 is formed with air holes 73 for allowing air to circulate, thereby ensuring the air communication function through the communication hole 61.

Figure 11:
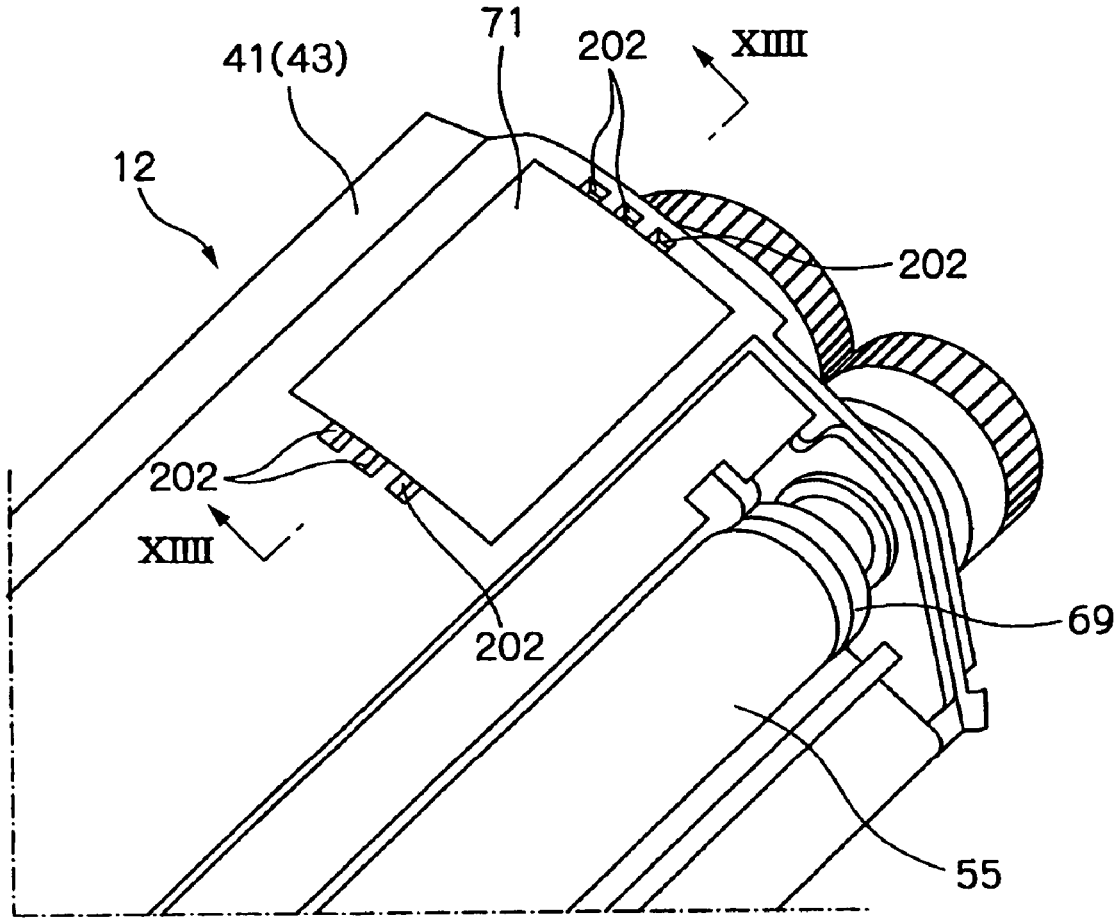
FIG. 11 is a perspective view from a label indication face to show a first embodiment of air communication unit of developing cartridge with a gap provided between a sticker and a label according to the invention.
Figure 12:
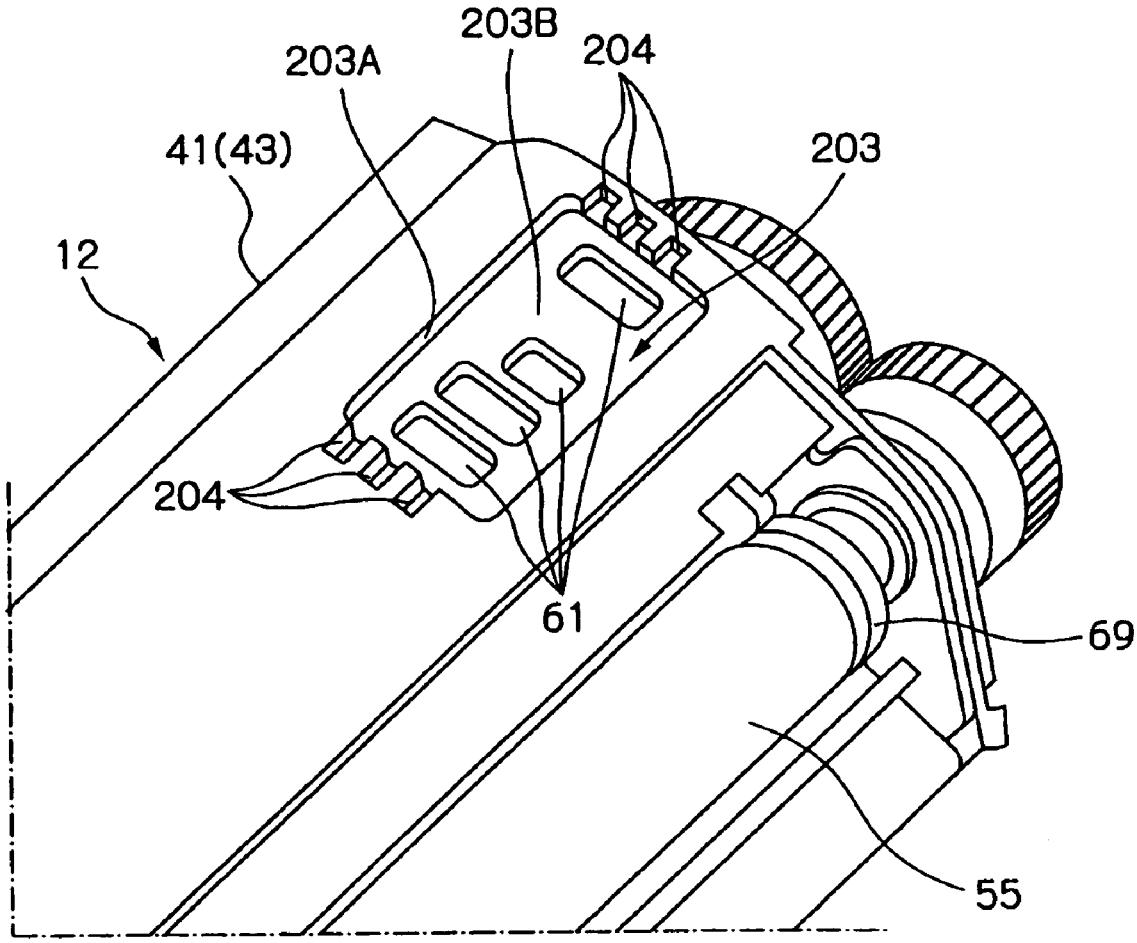
FIG. 12 is a perspective view to show the surface shape of a housing in FIG. 11.
Figure 13:
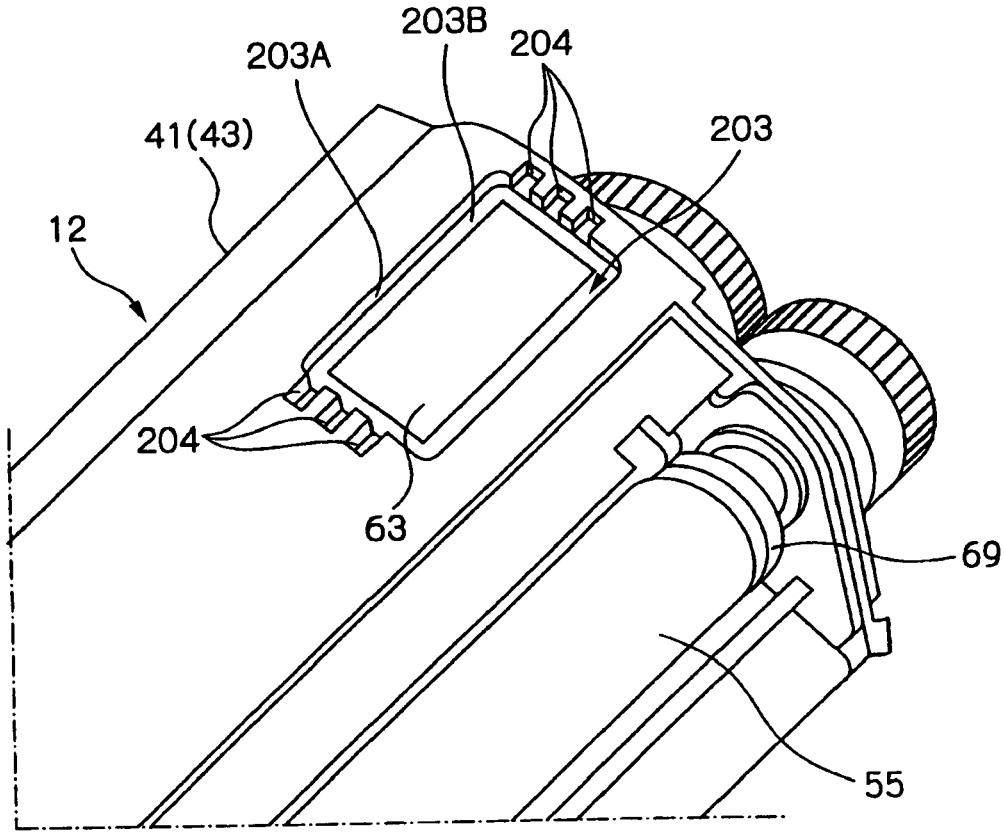
FIG. 13 is a perspective view to show a state in which a sticker is put on an indentation in FIG. 12.
Figure 14:
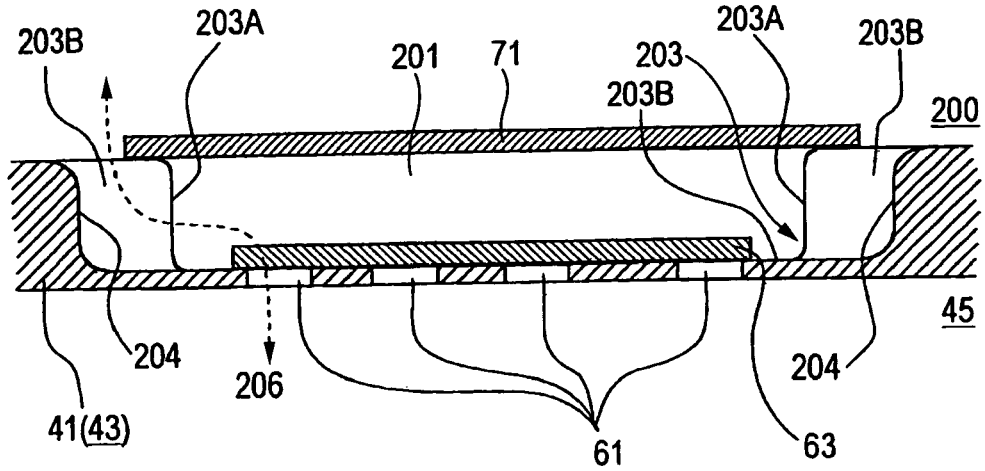
FIG. 14 is a sectional view taken on line XIIII—XIIII in FIG. 11.

To use a label 71 not formed with air holes 73 for allowing air to circulate, the label 71 is put on the housing 43 so as to have a gap 201 between the label 71 and the sticker 63 and a communication passage 202 for allowing the gap 201 and an atmosphere 200 to communicate with each other, whereby the presence of the communication hole 61 can be hidden without blocking the minute holes of the sticker 63, as in embodiments shown in FIGS. 11 to 20. The embodiments will be discussed below:

FIG. 11 is a perspective view from the label indication face to show a first embodiment of air communication unit of developing cartridge with a gap provided between a sticker and a label. FIG. 12 is a perspective view to show the surface shape of a housing in FIG. 11. FIG. 13 is a perspective view to show a state in which a sticker is put on an indentation in FIG. 12. FIG. 14 is a sectional view taken on line XIIII—XIIII in FIG. 11.

The air communication unit of the developing cartridge 12 shown in FIG. 11 includes communication passages 202 on the peripheral surface of housing 43 for enabling the air in the toner storage portion 45 to be made fresh. To begin with, the configuration of the air communication unit of the developing cartridge 12 in the embodiment will be discussed with reference to FIGS. 12 and 13, followed by description about a communication path from the toner storage portion 45 to the atmosphere 200 with reference to FIG. 14.

FIG. 12 shows the shape of the housing 43 in the surroundings of the air communication unit of the developing cartridge 12 in the embodiment. The housing 43 is formed on a surface with a roughly rectangular depression 203 long in the axial direction of the developing roller 55. A plurality of communication holes 61 are made in a bottom 203B of the depression 203. Further, a plurality of grooves 204 are formed so as to extend in the axial direction of the developing roller 55, and reach a side 203A of the depression 203.

A sticker 63 is formed roughly like the same shape as the depression 203 as shown in FIG. 13 and is put on the bottom 203B so as to block the communication holes 61.

As shown in FIG. 14, a label 71 is put on the housing 43 so as to have a gap 201 between the label 71 and the sticker 63. At this time, the groove 204 formed on the surface of the housing 43 forms the communication passage 202 from the portion of the surface of the housing 43 where the label 71 is not put to the side 203A of the depression 203. This means that the groove 204 forms the communication passage 202 to allow the gap 201 and the atmosphere 200 to communicate with each other.

Further, the sticker 63 put on the bottom 203B is similar to the sticker in FIG. 2 and FIG. 5, etc., and is formed with a large number of minute holes each of the size to allow air to pass through and prevent toner from passing through, and the gap 201 and the toner storage portion 45 communicate with each other.

Therefore, in the developing cartridge 12 shown in FIGS. 11 to 14, the toner storage portion 45 and the gap 201 communicate with each other and the gap 201 and the atmosphere 200 communicate with each other, so that the toner storage portion 45 and the atmosphere 200 communicate with each other with the gap 201 between as indicated by arrows 206, making it possible to make fresh the air in the toner storage portion 45.

Also in the embodiment, the communication holes 61 in the developing cartridge 12 may be formed in either the upper housing member 41 or the lower housing member 42 or may be formed in both the upper housing member 41 and the lower housing member 42. Preferably, the communication holes 61 are formed in the surroundings of the abutment regulation roller 69 as shown in FIGS. 11 to 13. For simplicity, the abutment regulation roller 69 is not shown in FIGS. 2, 3, 9, and 10.

The gap 201 is not limited to the form shown in the embodiment and can also be formed by heaping up the surroundings of the communication hole 61 of the housing 43 in the related art to provide a bank-like enclosure and putting the label 71 on the enclosure. At this time, it is also possible to provide the communication passage 202 by making a hole in the enclosure.

However, as shown in the embodiment, the gap 201 and the communication passage 202 are provided by forming the depression 203 and the groove 204 in the surface of the housing 43, whereby the contours of the housing 43 can be shaped almost like those of the housing in the related art, and the gap 201 and the communication passage 202 can be provided without upsizing the developing cartridge 12 more than necessary.

Figure 15:
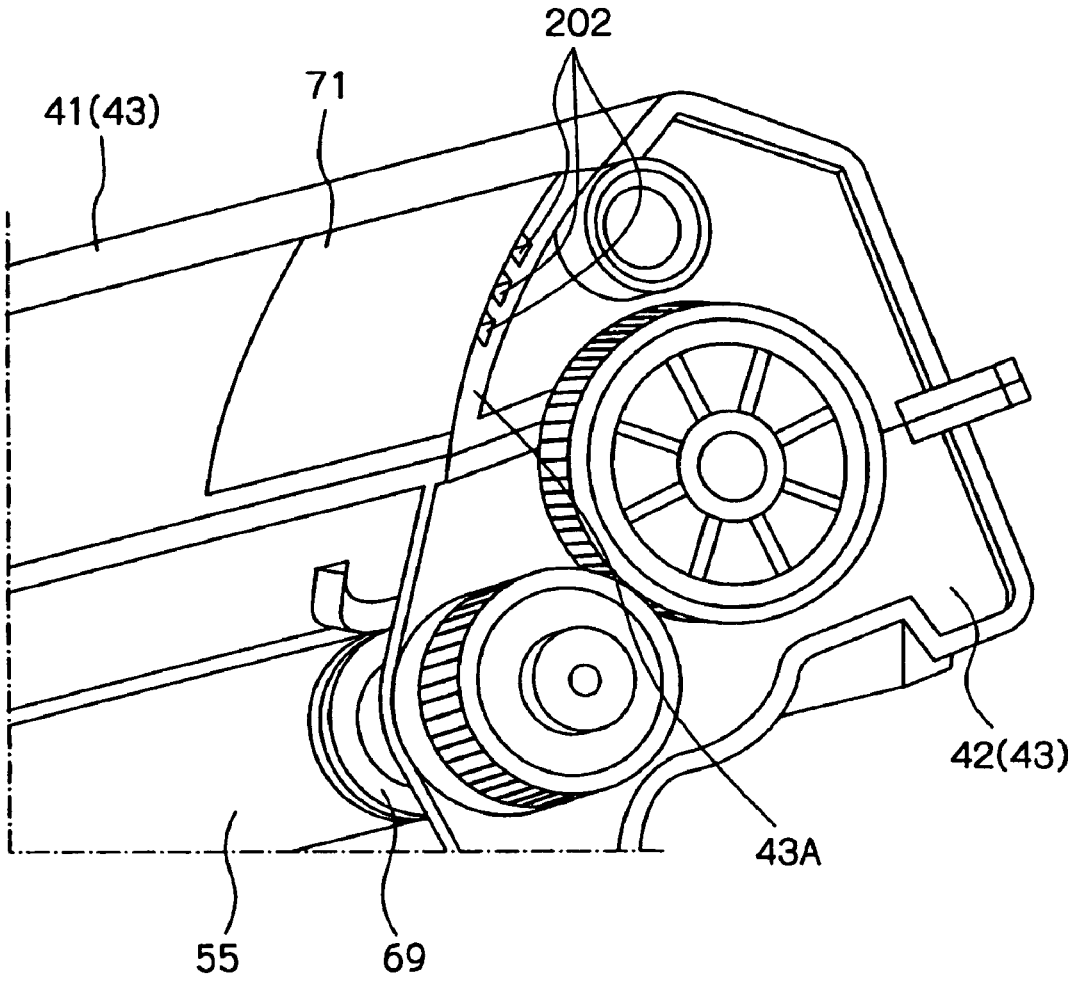
FIG. 15 is a perspective view from the housing end face side to show a second embodiment of air communication unit of developing cartridge with a gap provided between a sticker and a label according to the invention.
Figure 16:
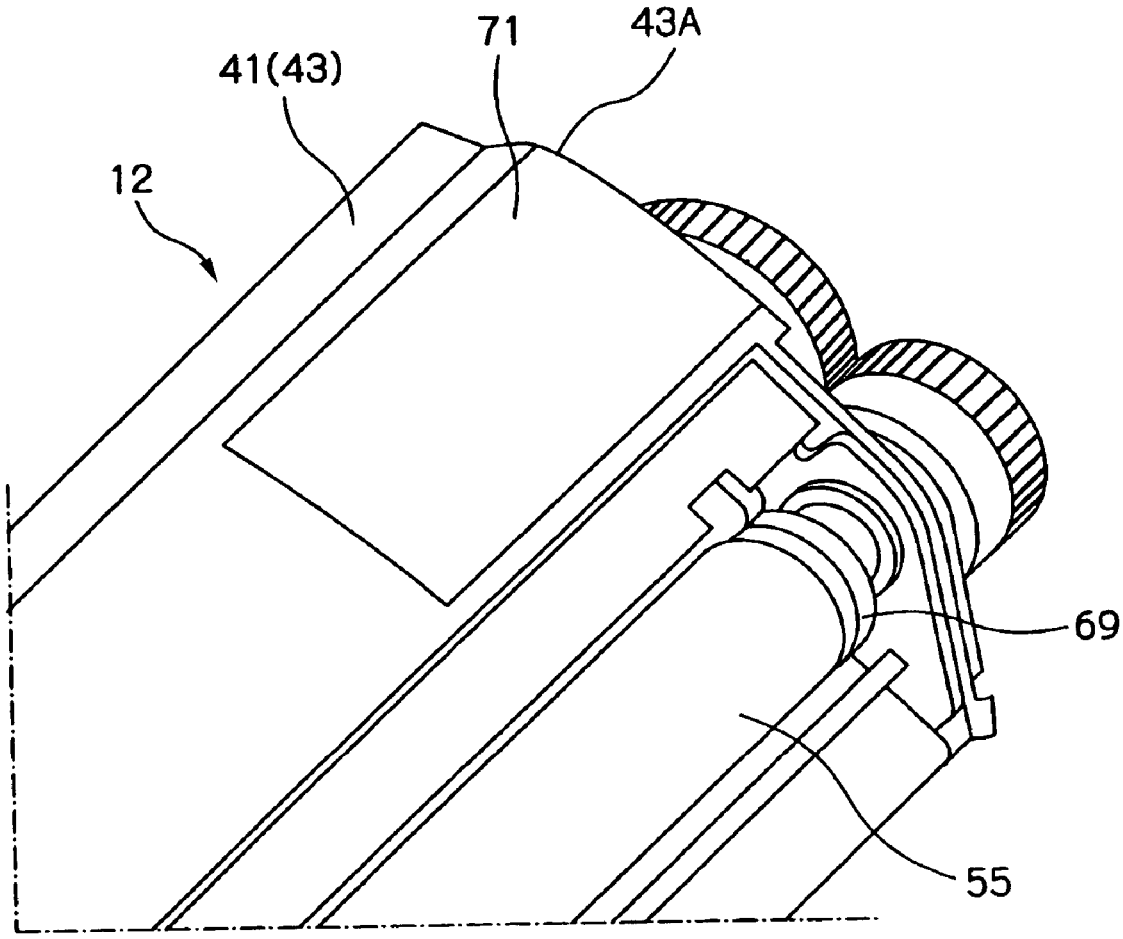
FIG. 16 is a perspective view from the label indication face of the air communication unit in FIG. 15.
Figure 17:
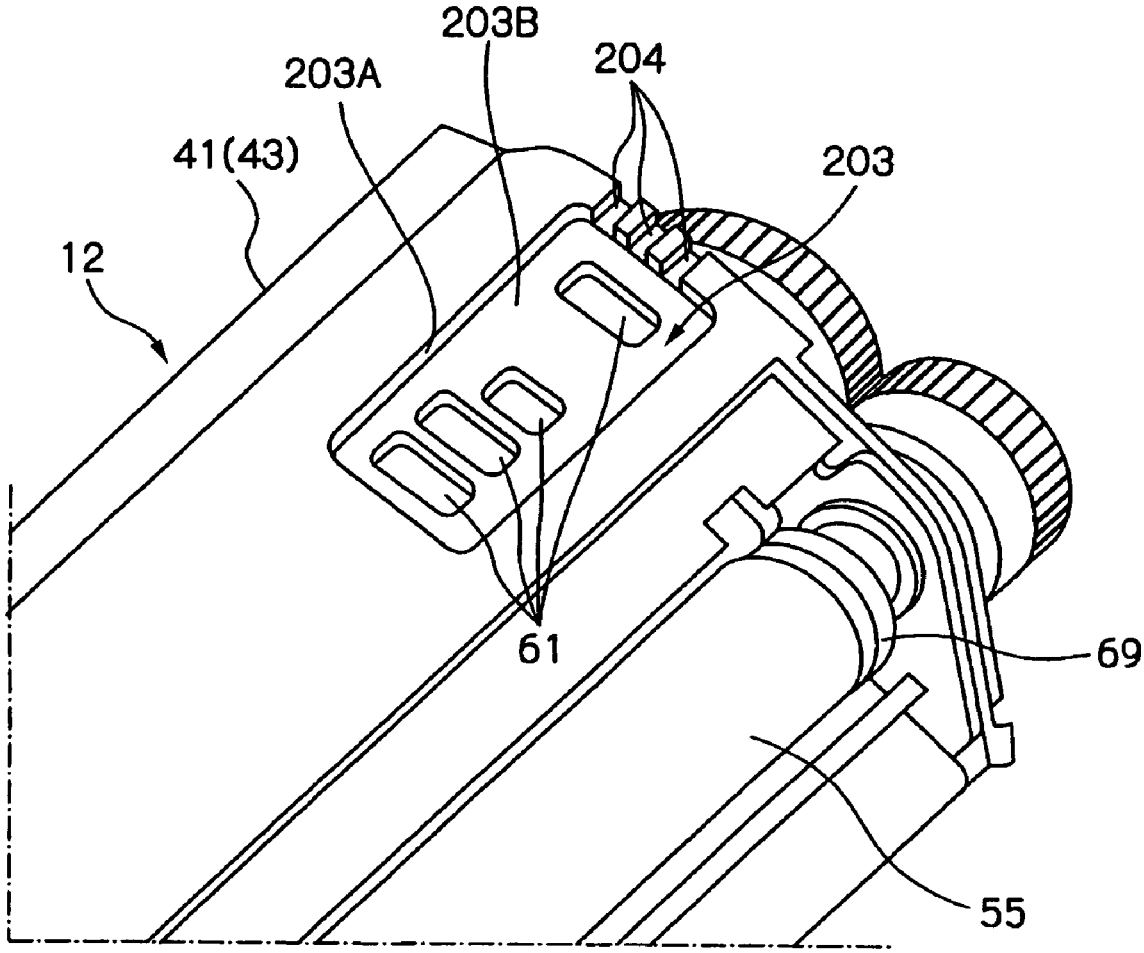
FIG. 17 is a perspective view to show the surface shape of housing in FIG. 16.
Figure 18:
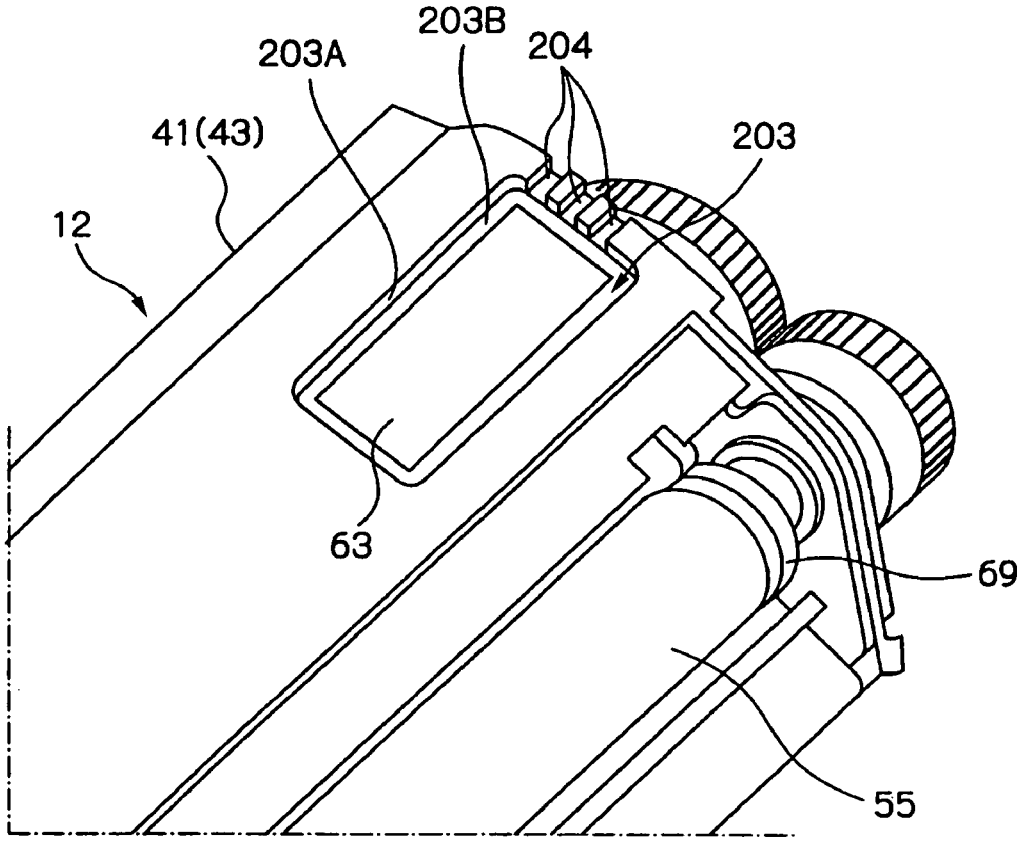
FIG. 18 is a perspective view to show a state in which a sticker is put on an indentation in FIG. 17.

FIG. 15 is a perspective view from the housing end face side to show a second embodiment of air communication unit of developing cartridge with a gap provided between a sticker and a label. FIG. 16 is a perspective view from the label indication face of the air communication unit in FIG. 15. FIG. 17 is a perspective view to show the surface shape of housing in FIG. 16. FIG. 18 is a perspective view to show a state in which a sticker is put on an indentation in FIG. 17.

In the air communication unit of the developing cartridge 12 shown in FIG. 15, communication passages 202 formed in housing 43 are formed so as to reach an end face 43A of the housing 43. When the air communication unit of the developing cartridge 12 is viewed from the indication face side of a label 71, the label 71 is only put and the presence of the air communication unit is hidden, as shown in FIG. 16. The configuration of the air communication unit of the developing cartridge 12 in the embodiment will be discussed with reference to FIGS. 17 and 18.

FIG. 17 shows the shape of the housing 43 in the surroundings of the air communication unit of the developing cartridge 12 in the embodiment. The housing 43 is formed on a surface with a roughly rectangular depression 203 long in the axial direction of the developing roller 55. A plurality of communication holes 61 are formed on a bottom 203B of the depression 203. Further, a plurality of grooves 204 are formed so as to extend in the axial direction of the developing roller 55, and reach the end face 43A of the housing 43 from a side 203A of the depression 203.

A sticker 63 is put on the bottom 203B of the depression 203 so as to block the communication holes 61 as shown in FIG. 18 and further the label 71 is put on the housing 43 so as to cover the depression 203 and the grooves 204 as shown in FIG. 16.

Also in the embodiment, as in the first embodiment of the air communication unit of the developing cartridge 12 having the gap 201 formed between the sticker 63 and the label 71, the toner storage portion 45 and a gap 201 communicate with each other and the gap 201 and an atmosphere 200 communicate with each other, so that the toner storage portion 45 and the atmosphere 200 communicate with each other with the gap 201 between, making it possible to interchange the air in the toner storage portion 45.

According to the embodiment, as already described, the communication passages 202 are formed in the end face 43A of the housing and are hard to be conspicuous and cannot be recognized from the indication face side of the label 71. Thus, the user can be prevented from carelessly cutting the label 71 from the communication passage 202 and peeling off the sticker 63 so that toner 47 is released.

The contours of the housing 43 can be shaped almost like those of the housing in the related art, and the gap 201 and the communication passage 202 can be provided without upsizing the developing cartridge 12 more than necessary.

Also in the embodiment, the communication holes 61 in the developing cartridge 12 may be formed in either the upper housing member 41 or the lower housing member 42 or may be formed in both the upper housing member 41 and the lower housing member 42. Preferably, the communication holes 61 are formed in the surroundings of the abutment regulation roller 69 as shown in FIGS. 15 to 17.

Figure 19:
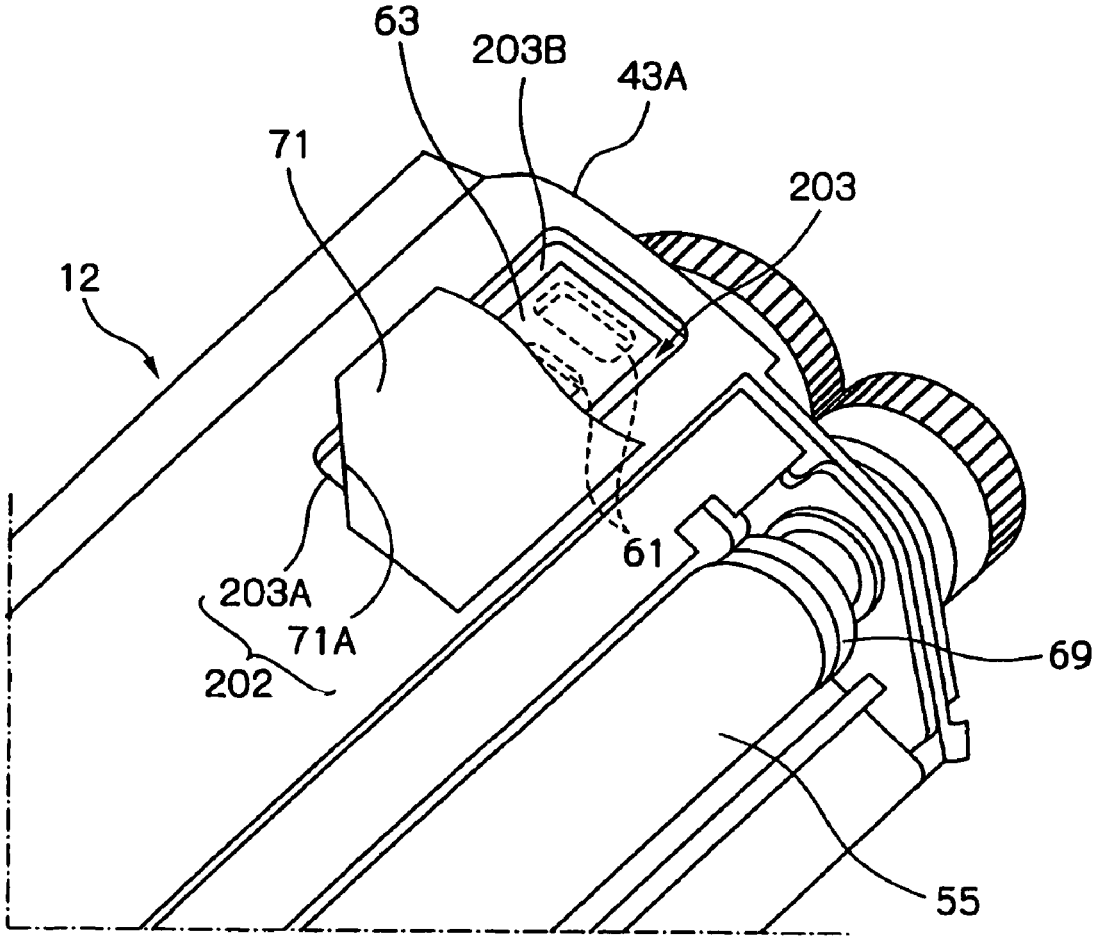
FIG. 19 is a perspective view from a label indication face to show a third embodiment of air communication unit of developing cartridge with a gap provided between a sticker and a label according to the invention.

FIG. 19 is a perspective view from the label indication face to show a third embodiment of air communication unit of developing cartridge with a gap provided between a sticker and a label. In FIG. 19, a label 71 is drawn where the end face 43A side of a housing 43 is not shown so that the shape of an depression 203 can be checked.

The housing 43 is formed on a surface with the roughly rectangular depression 203 long in the axial direction of the developing roller 55, and a plurality of communication holes 61 are formed on a bottom 203B of the depression 203.

A sticker 63 is put on the bottom 203B of the depression 203 so as to block the communication holes 61, and the label 71 is put on the housing 43 so as to almost cover the depression 203.

The embodiment differs in the first or second embodiment of the air communication unit of the developing cartridge 12 having the gap 201 formed between the sticker 63 and the label 71 in that the housing 43 is not formed with any groove 204 for forming a communication passage 202. A part of the periphery of the label 71 is cut to form a cut part 71A for allowing the toner storage portion 45 and atmosphere 200 to communicate with each other.

That is, a communication passage 202 is constituted by the cut part 71A formed on the periphery of the label 71 and a side 203A of the depression 203.

Also in the embodiment, as in the first and second embodiments of the air communication unit of the developing cartridge 12 having the gap 201 formed between the sticker 63 and the label 71, the toner storage portion 45 and a gap 201 communicate with each other and the gap 201 and an atmosphere 200 communicate with each other, so that the toner storage portion 45 and the atmosphere 200 communicate with each other with the gap 201 between, making it possible to interchange the air in the toner storage portion 45.

According to the embodiment, the housing 43 need not be formed in the surface with any groove 204, etc., as the communication passage 202, and design change made to the housing 43 in the related art can be minimized.

According to the invention, the housing 43 need not be formed in the surface with any groove 204, etc., as the communication passage 202, so that the adhesive surface of the label 71 becomes uniform. That is, an uneven portion of a groove 202, etc., need not be formed in the margin of the depression 203 to bond the label 71 and the adhesive surface of the label 71 can be made uniform without bonding the label 71 to an uneven portion and by extension the label 71 can be prevented from peeling off.

The contours of the housing 43 can be shaped almost like those of the housing in the related art, and the gap 201 and the communication passage 202 can be provided without upsizing the developing cartridge 12 more than necessary.

Also in the embodiment, the communication holes 61 in the developing cartridge 12 may be formed in either the upper housing member 41 or the lower housing member 42 or may be formed in both the upper housing member 41 and the lower housing member 42. Preferably, the communication holes 61 are formed in the surroundings of the abutment regulation roller 69 as shown in FIG. 19.

The embodiments wherein the label 71 does not require any air hole 73 for allowing air to flow have been described. The three embodiments previously described with reference to FIGS. 11 to 19 are embodiments wherein the label 71 does not require any air hole 73 for allowing air to flow; the label 71 may be formed with an air hole 73 for allowing air to flow. To use the label 71 formed with the air hole 73, the discharging effect of the air in the housing 43 and the suction effect of the outside air into the housing 43 are sill more enhanced.

Next, another embodiment of the invention will be discussed. For example, in the embodiment previously described with reference to FIG. 19, to put the label 71 on the surface of the upper housing member 41, release paper put on the back of the label 71 is stripped and the false face with an adhesive is put toward the sticker 63. However, in the portion where the false face of the label 71 is opposed to the sticker 63, a human being presses the label 71 from above by mistake or the label 71 warps downward, whereby it is feared that the false face may be bonded to the label 71 and consequently it may be made impossible to secure the communication passage from the surface of the sticker 63 to the atmosphere.

Figure 20:
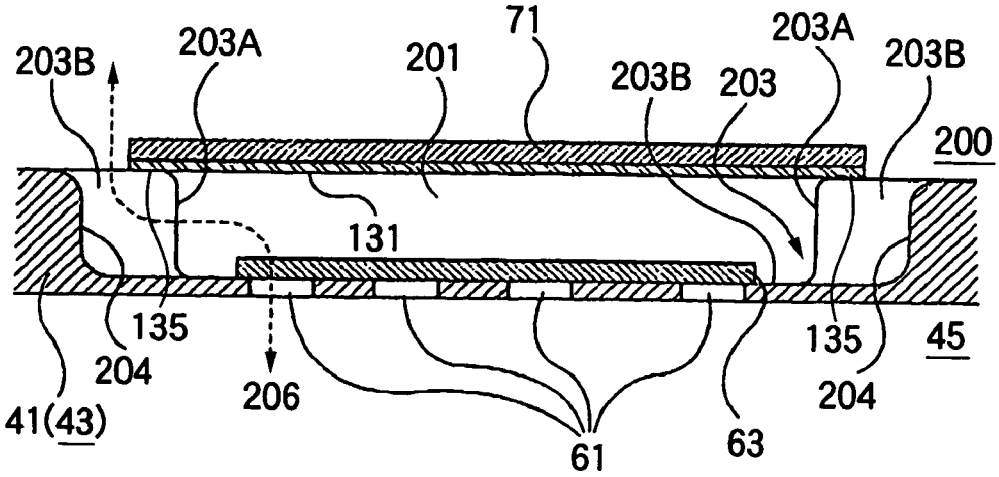
FIG. 20 is a sectional view to show an embodiment wherein gap securing means is provided for securing a gap between a sticker and a label.

Then, in the embodiment, gap securing means is provided for securing a gap between a sticker 63 and a label 71. FIG. 20 specifically shows gap securing means. The embodiment differs from the embodiment previously described with reference to FIG. 14 in that release paper 131 of adhesion prevention means is placed at a position opposed to the sticker 63, on the lower fade of the label 71. Members or parts identical with those previously described with reference to FIG. 14 are denoted by the same reference numerals in FIG. 20.

Figure 21:
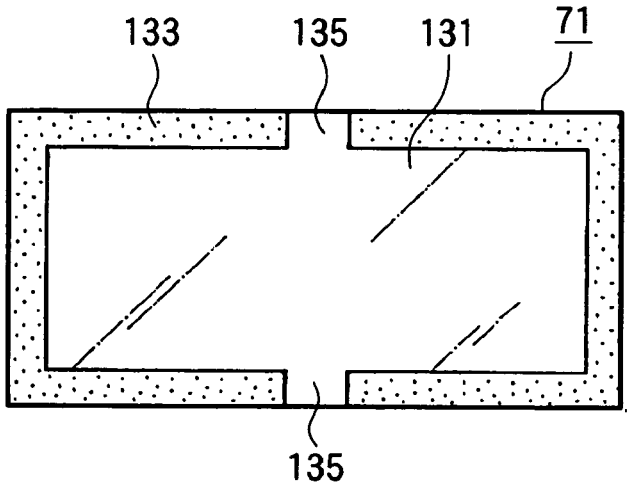
FIG. 21 shows an embodiment wherein release paper is formed with a drop prevention portion.

FIG. 21 is a drawing to show the position at which the release paper 131 is placed on the back of the label 71 and the shape of the label. As seen in the figure, the release paper is not provided and an adhesive 133 is exposed in the surrounding portion for putting the label 71 on the upper housing member 41, and the release paper 131 is not stripped and remains in other portions, namely, an inner area of the label 71 not put on the upper housing member 41. Since an adhesive is applied fully to the back of the label 71 for the reason of cost reduction, the release paper is provided on the full back of the label 71 in the beginning. As shown in FIG. 21, the boundary between the portion in which the release paper is left intact and the portion in which the release paper is stripped and the adhesive is exposed is notched, and the release paper only in the surrounding portion of the back is stripped at the use time, whereby the label 71 becomes as shown in FIG. 21.

In FIG. 21, a portion denoted by reference numeral 135 is a drop prevention portion projected from the outer periphery of the remaining release paper 131. The drop prevention portion 135 is formed so as to project to only a part of the adhesive 133 on the periphery of the back of the label 71. In FIG. 21, the drop prevention portion 135 is formed only at two places at the centers of the long sides of the label 71; in addition, the drop prevention portion 135 may be provided in the vicinity of the center of the short side of the label 71 and in a corner of the label 71.

As the drop prevention portion 135 is provided, the adhesive of the label 71 adheres to the surface of the upper housing member 41 on both sides of the drop prevention portion 135 and thus the drop prevention portion 135 is sandwiched between the label 71 and the surface of the housing. Accordingly, the release paper 131 can be prevented from peeling off and dropping from the back of the label 71. As the configuration of securing a gap between the label 71 and the sticker 63 using the release paper 131 as in the embodiment is adopted, the release paper 131 can be easily stripped and other portions can be easily recycled at the recycling time of the developing cartridge.

In the embodiment, the release paper 131 is named as the adhesion prevention means, but paper, a cloth, a plastic sheet, or the like having no adhesion rather than the release paper 131 can also be put on the position opposed to the sticker 63 to cover the adhesive face of the label 71 for inhibiting adhesion of the sticker 63 and the label 71. When paper, a cloth, a plastic sheet, or the like having no adhesion is put on the label 71, if there is no risk of dropping, the drop prevention portion 135 need not be formed.

Using the fact that release paper usually has one side to which a release agent is applied and the other side to which no release agent is applied, the release paper 131 may be once peeled off, for example, from the state in which the release paper 131 is provided as shown in FIG. 21, and may be turned inside out and again put on the same position of the label 71. In doing so, the side with no release agent applied thereto is put on the label 71 and thus the possibility that the release paper 131 will drop from the label 71 is extremely small. Therefore, to adopt such a method, the drop prevention portion 135 need not be formed.

Figure 22:
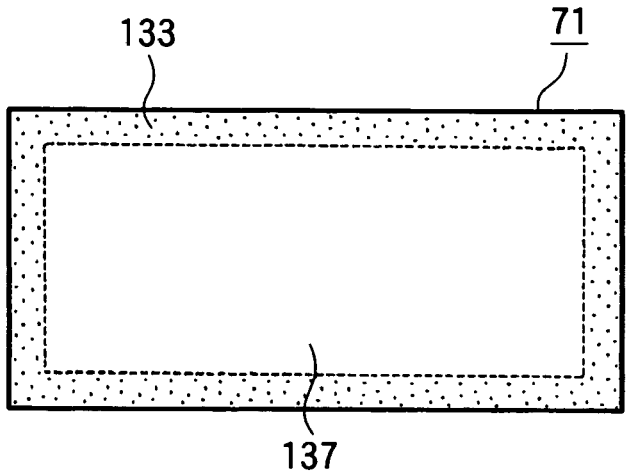
FIG. 22 shows an embodiment of a label having a portion having no adhesive.

As another example of the gap securing means, a configuration in which a portion 137 not provided with an adhesive on the back of the label 71 is formed in the portion of the label 71 opposed to the sticker 63 as shown in FIG. 22, a configuration in which a plurality of thin projections extending from the sticker 63 are formed in the portion of the label 71 opposed to the sticker 63 to secure the distance between the sticker 63 and the label 71 for maintaining communication of air although not shown, or the like can be named.

Next, the structure of the surroundings of the developing roller 55 in the developing cartridge 12 will be discussed. A roller support frame 75 is fixed to the housing 43 of the developing cartridge 12. The roller support frame 75 is formed all of metal and is made up of a lower frame part 77, side frame parts 79*a* and 79*b* bent at 90 degrees from both ends of the lower frame part 77, and an upper frame part 83 connected to the upper ends of the side frame parts 79*a* and 79*b* by screws 81. The developing roller 55 can be placed in the area surrounded by the lower frame part 77, the upper frame part 83, and the two side frame parts 79*a* and 79*b*.

A blade fixing frame 85 is attached to the lower frame part 77 by a plurality of fixing screws 87, and a blade support frame 89 made of phosphor bronze is provided between the blade fixing frame 85 and the lower frame part 77, as shown in FIG. 4. A regulation blade 91 made of rubber, a resin material, etc., is put on the top of the tip of the blade support frame 89, and is pressed at a constant pressure against the peripheral surface of the developing roller 55 over the length direction thereof by the spring return action of the blade support frame 89 itself and the elastic return action of a backup sponge 93 (see FIG. 4) provided on the lower side of the tip of the blade support frame 89.

The regulation blade 91 has a function of charging the toner 47 to the same polarity, as the toner 47 rubs with the regulation blade 91. The toner thus charged to a predetermined polarity is supplied to the developing roller 55, and the electrostatic latent image on the photoconductor drum 5 can be developed by the toner 47 on the developing roller 55.

The regulation blade 91 also has a function of uniformly leveling the toner 47 deposited on the peripheral surface of the developing roller 55 so that the thickness of the toner layer finally becomes about 20 μm, for example. Therefore, to even the thickness of the toner 47 in the length direction of the developing roller 55, it is important for the developing cartridge 12 that the regulation blade 91 is pressed at a constant pressure against the peripheral surface of the developing roller 55 over the length direction thereof.

To ensure averaging the press pressure of the regulation blade 91 against the developing roller 55, the upper frame part 83 is added as the component of the roller support frame 75 as described above so that the roller support frame 75 becomes a closed loop structure.

That is, such a closed loop structure is adopted and the developing roller 55 and the regulation blade 91 are put into a unit, whereby the shape retention of the roller support frame 75 is enhanced. Thus, when the developing cartridge 12 is placed in the storage section 37 of the rotary developing unit 11 or is detached therefrom, if a considerable force is applied to the roller support frame 75, the positional relationship between the peripheral surface of the developing roller 55 and the regulation blade 91 becomes hard to change over the length direction. Accordingly, the regulation blade 91 always continues to press the peripheral surface of the developing roller 55 by a constant force over the length direction, so that the distribution of the toner 47 on the peripheral surface of the developing roller 55 can be prevented from being unbalanced in the length direction of the developing roller 55 and a print failure of inconsistencies in color density or the like can be prevented.

Figure 9:
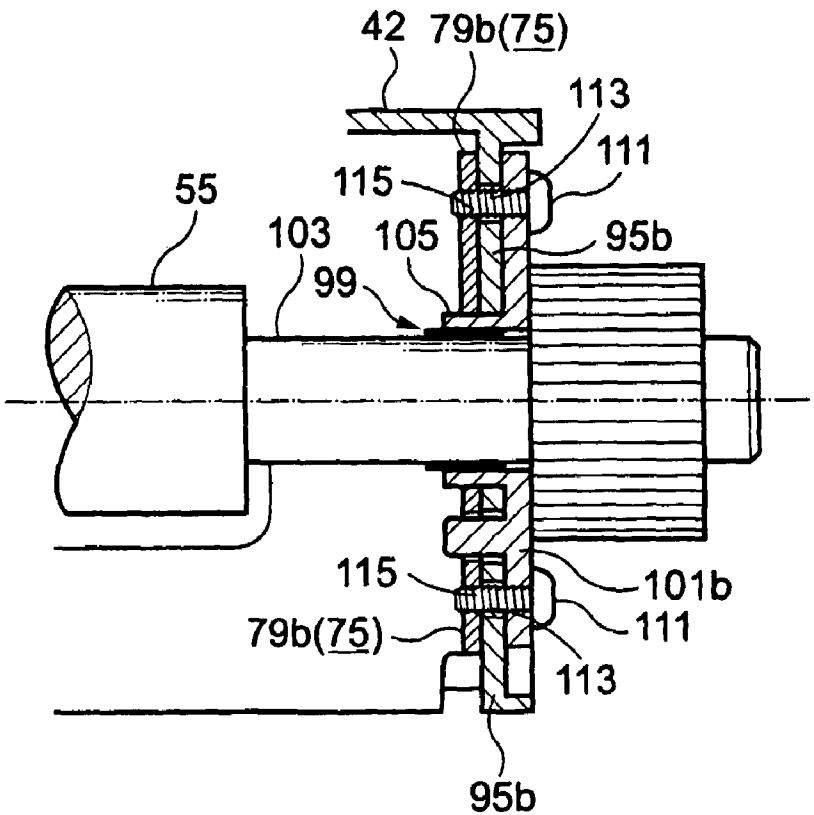
FIG. 9(*a*) is a sectional view to show how a shaft is supported with the left of the developing roller in FIG. 3 broken away according to the invention, and FIG. 9(*b*) is a sectional view to show how the shaft is supported with the right of the developing roller in FIG. 3 broken away.
Figure 9:
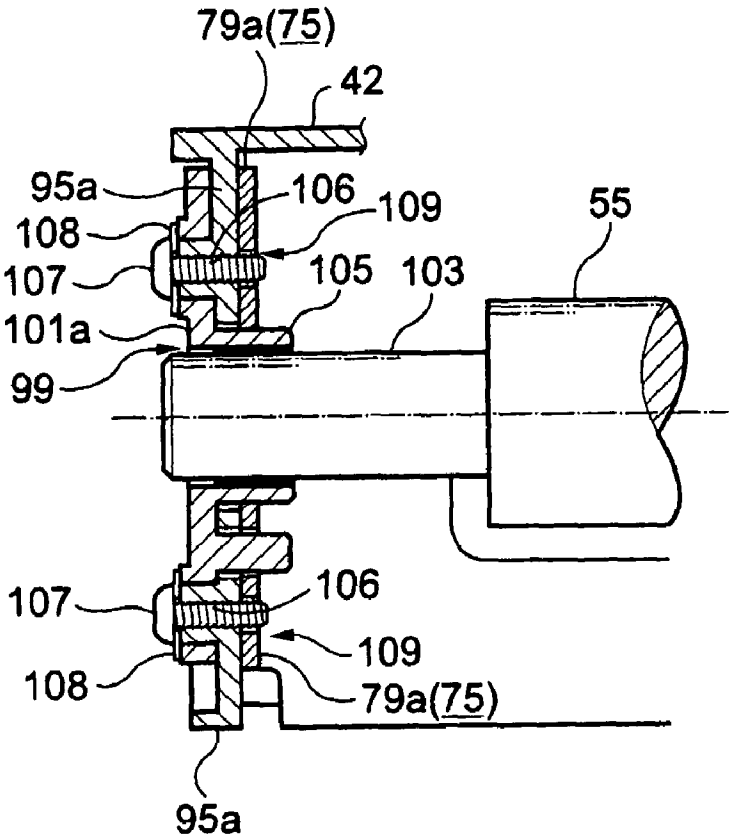
Figure 10:
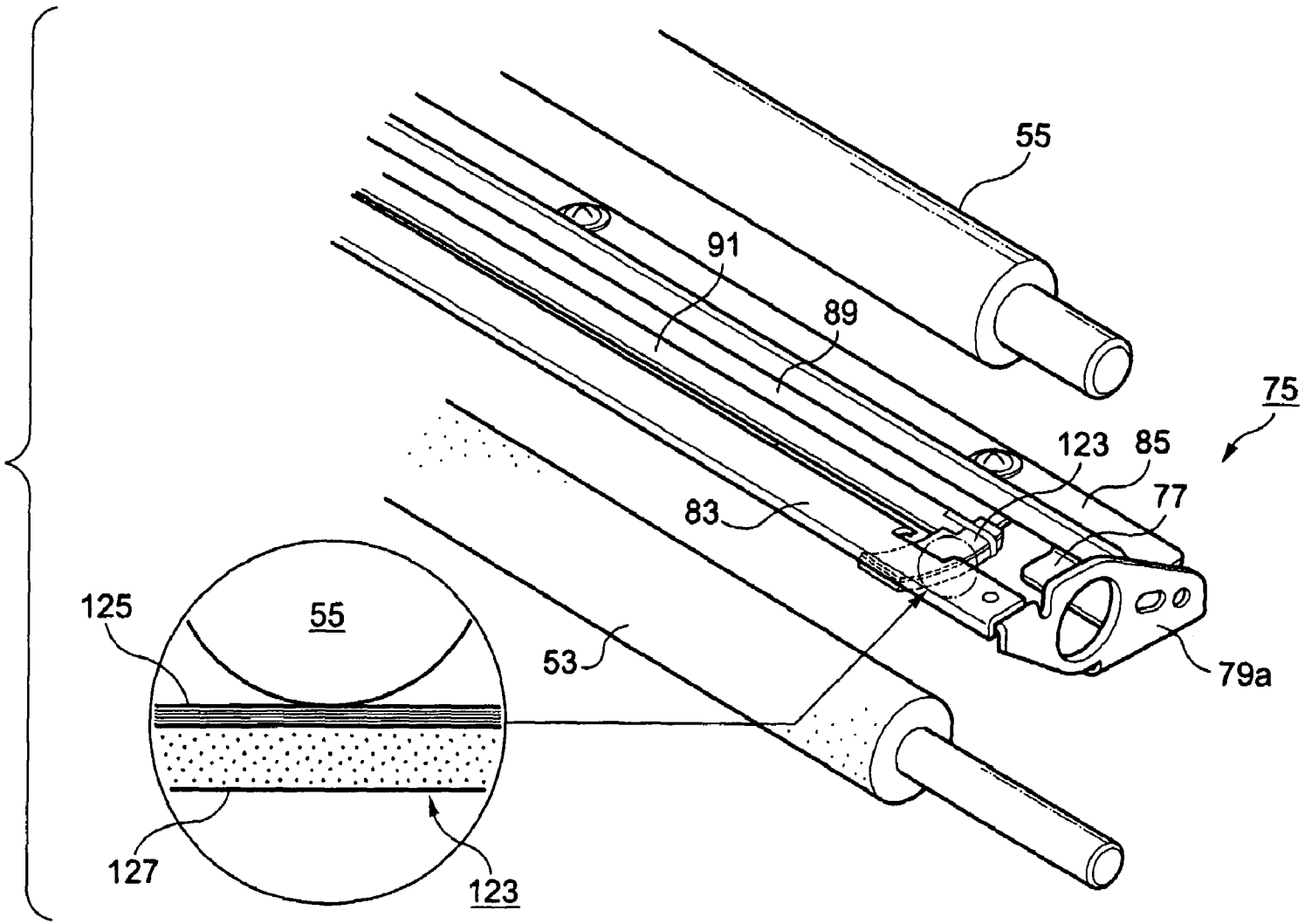
FIG. 10 is a perspective view to show the roller support frame and a supply roller and the developing roller supported on the roller support frame according to the invention.

Next, the structure of attaching the roller support frame 75 to the lower housing member 42 will be discussed with reference to FIGS. 9(*a*) and 9(*b*). FIG. 9(*a*) shows how a shaft 103 is supported with the left of the developing roller 55 in FIG. 3 broken away, and FIG. 9(*b*) shows how the shaft is supported with the right of the developing roller 55 in FIG. 3 broken away.

As shown in FIGS. 9(*a*) and 9(*b*), a supply roller through hole (not shown) and a developing roller through hole 99 are formed in end faces 95*a* and 95*b* of the lower housing member 42, and shaft retention members 101*a* and 101*b* are provided outside the end faces 95*a* and 95*b*. Although not shown, both end parts of the shaft of the supply roller 53 are supported on a shaft retention section (not shown) extending into the supply roller through hole from the shaft retention members 101*a* and 101*b* for rotation.

Both end parts of the shaft 103 of the developing roller 55 are supported on a shaft retention section 105 extending into the developing roller through hole 99 from the shaft retention members 101*a* and 101*b* for rotation. As shown in FIG. 9(*a*), two holes 106 each a little smaller than the thread of a screw 107 are formed in the left end face 95*a* of the lower housing member 42 and the screws 107 are forcibly screwed into the holes via washers 108, whereby the left shaft retention member 101*a* and the left end face 95*a* of the lower housing member 42 are fixed. The left side frame part 79*a* of the roller support frame 75 is also formed with two holes for screws 107 at the positions matching the holes 106 in the left end face 95*a* of the lower housing member 42. The holes are unloaded holes 109 larger than the threads of the screws 107 and the screws 107 are inserted into the unloaded holes 109.

On the other hand, as shown in FIG. 9(*b*), two unloaded holes 113 each larger than the thread of a screw 111 are formed in the right end face 95*b* of the lower housing member 42 and the right side frame part 79*b* of the roller support frame 75 is formed with two screw holes 115 each formed with a female screw for the screw 111 at the match positions. The screws 111 are screwed into the unloaded holes 113 and the screw holes 115 from holes made in the right shaft retention member 101*b*, whereby the right shaft retention member 101*b*, the right end face 95*b* of the lower housing member 42, and the right side frame part 79*b* are fixed in one piece.

As the result of adopting the configuration, the housing 43 and the roller support frame 75 are fixed to each other on the right side so that a move in the length direction of the housing is regulated; the side frame part 79*a* of the roller support frame 75 is not fixed to the end face 95*a* of the lower housing member 42 on the left side. Thus, it is made possible for the housing 43 and the roller support frame 75 to move freely in the length direction of the housing without receiving the mutual effect.

The reason why the configuration is adopted is that the resin of which the housing 43 is made has a larger thermal expansion coefficient than the metal of which the roller support frame 75 is made and thus thermal change causes the housing 43 and the roller support frame 75 to differ in difference between expansion and contraction (the housing 43 has a larger difference between expansion and contraction than the roller support frame 75) and the effect of the difference between expansion and contraction needs to be eliminated. That is, as the above-described configuration is adopted, distortion of the roller support frame 75 caused because they differ in difference between expansion and contraction can be prevented, so that the abutment pressure of the regulation blade 91 against the outer peripheral surface of the developing roller 55 provided on the roller support frame 75 can be continuously maintained constant over the length direction, making it possible to supply toner uniformly over the length direction.

Although not clearly shown in FIGS. 9(*a*) and 9(*b*), a slight gap is formed between the end face 95*a* of the lower housing member 42 and the side frame part 79*a* of the roller support frame 75 even in the state in which the lower housing member 42 is most contracted.

Next, the structure for preventing the toner 47 from scattering from the toner storage portion 45 in the housing 43 to the outside will be discussed. As shown in FIG. 4, a scattering prevention seal member 117 is fixed at one end to the upper frame part 83 of the roller support frame 75 above the developing roller 55, and is pressed at an opposite end against the developing roller 55 by a backup sponge 119 fixed to the lower housing member 42. Accordingly, scattering of the toner 47 to the outside from the nip between the developing roller 55 and the upper frame part 83 is prevented.

A seal member 121 is put on the inside of the upper frame part 83 of the roller support frame 75 for blocking the gap between the lower housing member 42 and the upper frame part 83, thereby preventing the toner 47 passing through the backup sponge 119 from scattering to the outside.

Figure 8:
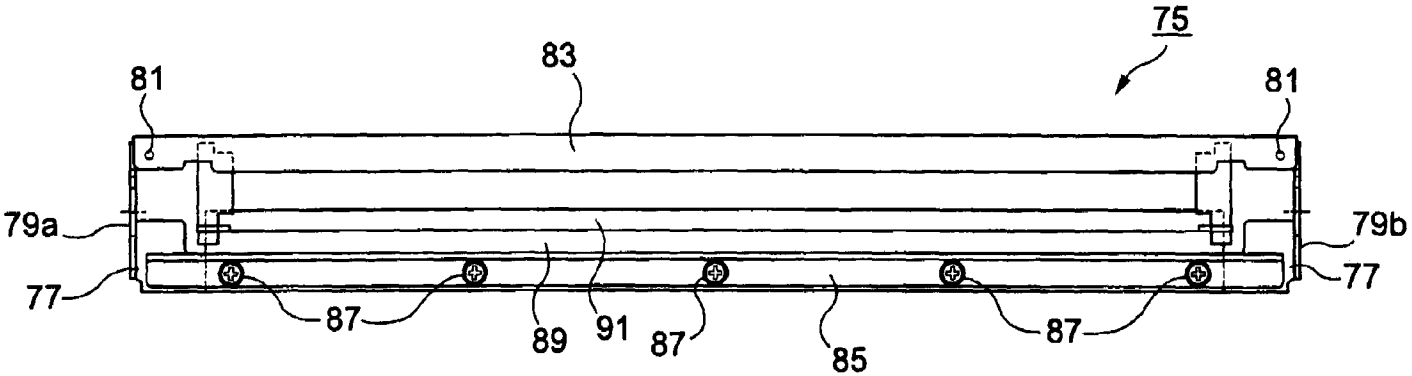
FIG. 8(*a*) is a front view to show the whole of a roller support frame according to the invention.
Figure 8:
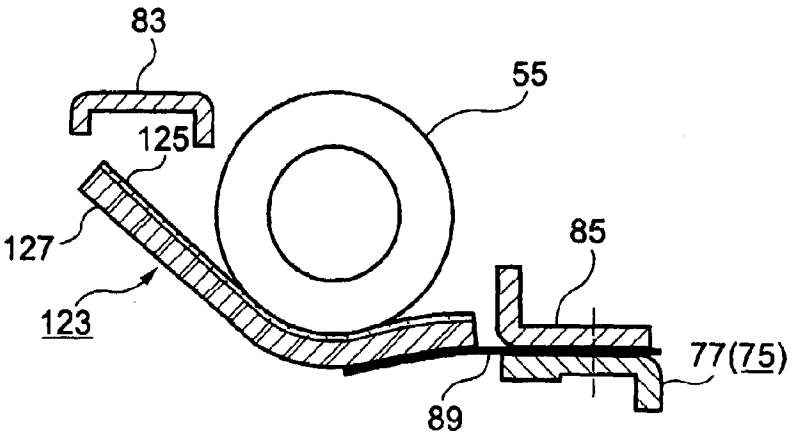
Figure 8:
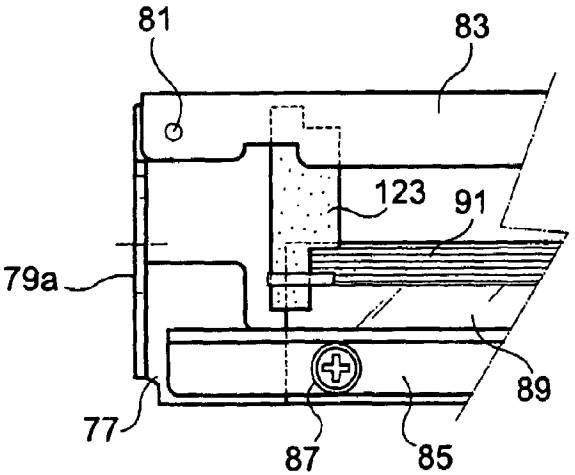

Further, as shown in FIGS. 8(*c*) and 10, a roller end seal member 123 abuts both end parts of the peripheral surface of the developing roller 55 for preventing the toner 47 from scattering from the end part of the developing roller 55 to the outside. As shown in a partially enlarged view in FIG. 10, the roller end seal member 123 is of a double structure wherein an upper low-friction function member 125 and a lower powder seal function member 127 are stuck together. The upper low-friction function member 125 is formed of a material excellent in durability against rotation wear to lessen the rotation frictional resistance on the contact face with the developing roller 55 as much as possible, such as Fujiron 7000 (registered trademark) (manufactured by Fujiko kabushiki kaisha). The lower powder seal function member 127 is formed of a material excellent in seal function property of powder of toner, etc., such as wool felt.

The roller end seal member 123 is fixed on the base end side to the blade support frame 89 or the lower frame part 77 and is supported on the tip side by the lower housing member 42 from the lower side, but not fixed to the lower housing member 42 and is a free end.

As the tip side of the roller end seal member 123 is made a free end, the following can be circumvented: Since the contact state between the peripheral surface of both ends of the developing roller 55 and the roller end seal member 123 changes delicately over time, only the same part of the roller end seal member 123 wears out like a groove and the sticker performance is degraded.

According to the invention, the rotary developing unit rotates around the rotation shaft, whereby the toner in the housing drops in a stroke, so that the air below the toner at the time is pushed out in a stroke through the communication holes formed in the lower side of the peripheral surface of the housing and on the other hand, the outside air can be forcibly pulled into the space occupied by the toner through the communication holes formed in the upper side of the peripheral surface of the housing.

If the communication hole is formed in either or both of the upper face and the lower face of the housing, air is pulled in through the communication hole formed in the upper face of the peripheral surface of the housing in the beginning and air is pushed out through the communication hole formed in the lower face. Then, when the rotary developing unit rotates 180 degrees, the communication holes formed in the upper and lower faces function in opposite manner. Thus, whenever the rotary developing unit rotates, air is discharged and sucked alternately through the same communication hole with a move of toner, so that rapid pressure adjustment in the housing is made.

In the developing cartridge of the present invention, it is explained that a toner cartridge portion for containing the toner and the developing roller portion for moving the toner of the toner cartridge portion to the photoconductor drum are integrally formed. However, the developing cartridge is not limited to the above configuration. The toner cartridge portion and the developing portion may be configured so as to separate each other and the toner cartridge portion, and the developing portion may be integrally attached when they are attached to the totally developing unit. In other words, the respective characterized configuration of the developing cartridge of the present embodiment may be preferably used in a case that the respective characterized configurations are applied to a toner cartridge which has no developing roller.

Although the present invention has been shown and described with reference to specific preferred embodiments, various changes and modifications will be apparent to those skilled in the art from the teachings herein without deviating from the spirit and scope of the present invention.

This patent application is based on Japanese patent application (JP-2002-074011) filed on Mar. 18, 2002, Japanese patent application (JP-2002-250098) filed on Aug. 29, 2002 and Japanese patent application (JP-2003-057192) filed on Mar. 4, 2003, and the contents of the Japanese patent applications are contained in this patent application for reference.

INDUSTRIAL APPLICABILITY

The rotary developing unit rotates around the rotation shaft, whereby the toner in the housing drops in a stroke, so that the air below the toner at the time is pushed out in a stroke through the communication holes formed in the lower side of the peripheral surface of the housing and on the other hand, the outside air can be forcibly sucked into the space occupied by the toner through the communication holes formed in the upper side of the peripheral surface of the housing. Therefore, according to the developing cartridge, the air communication unit of the developing cartridge, and the toner cartridge of the present invention, by using the fact that a rotary developing unit rotates on a rotation shaft to make it possible to forcibly discharge air in a developing cartridge or forcibly suck the outside air for promptly adjusting the pressure in the developing cartridge.

The invention claimed is:

1. A developing cartridge, comprising:

a housing, which has a peripheral surface and two end faces formed on both sides of the peripheral surface, a toner containing space surrounded by the peripheral surface and two end faces which contains toner therein, and the housing having a communication hole which communicates the toner containing space with an exterior; and a sticker, which is arranged so as to seal the communication hole, wherein the sticker has minute holes for allowing air to flow and preventing the toner from passing through, wherein the peripheral surface of the housing has an upper face and a lower face; and wherein the communication hole is formed in both of the upper face and the lower face.

2. The developing cartridge as set forth in claim 1 further comprising, a developing roller which provides the toner in the toner containing space to a conductor drum, the developing roller having a rotation shaft to be rotatably attached to the housing; and an abutment regulation roller, which regulates a distance between the developing roller and the conductor drum, and the abutment regulation roller attached to both ends of the rotation shaft of the developing roller, wherein the communication hole is formed in the vicinity of the abutment regulation roller.

3. The developing cartridge as set forth in claim 2, wherein the communication hole is formed so as to correspond a position of the abutment regulation roller.

4. The developing cartridge as set forth in claim 2 or 3, wherein the communication hole is constituted by a plurality of communication holes; and wherein one of the communication holes is formed at a center portion of the housing.

5. The developing cartridge as set forth in claim 1, wherein the communication hole is constituted by a plurality of small holes.

6. The developing cartridge as set forth in claim 1, further comprising a label, which is put on the sticker, wherein the label is formed with an air hole for allowing air to flow.

7. The developing cartridge as set forth in claim 1, further comprising a label which is put on the housing so as to have a gap between the label and the sticker, wherein a communication passage which communicates the gap to an atmosphere is formed.

8. The developing cartridge as set forth in claim 7, wherein the communication passage is constituted by a cut part formed on a periphery of the label and a side face of the depression.

9. The developing cartridge as set forth in claim 7, further comprising gap securing means which secures the gap between the sticker and the label.

10. The developing cartridge as set forth in claim 9, wherein the gap securing means is so configured that a back of the label opposed to the sticker is not provided with an adhesive.

11. The developing cartridge as set forth in claim 9, wherein the back of the label is fully provided with an adhesive; and wherein the gap securing means is so configured that the back of the label opposed to the sticker is provided with adhesion prevention means.

12. The developing cartridge as set forth in claim 11, wherein the adhesion prevention means is a release sheet which is put on the back of the label.

13. The developing cartridge as set forth in claim 12, wherein the release sheet is formed with a drop prevention portion projected from an outer periphery of the release sheet;

wherein the drop prevention portion is sandwiched between the label and the surface of the housing.

14. The developing cartridge as set forth in claim 12, wherein the release sheet has one side to which a release agent is applied and an opposite side to which no release agent is applied; and wherein the release sheet is peeled off and is turned inside out, and the side of the release sheet to which no release agent is applied is again put on the position where the release sheet is provided in the beginning so that the adhesion prevention means is formed.

15. The developing cartridge as set forth in claim 1, wherein the communication hole is provided on a bottom of a depression formed on the peripheral surface of the housing.

16. The developing cartridge as set forth in claim 15, further comprising a communication passage comprising a groove formed on the peripheral surface of the housing; and wherein the groove is formed so as to extend to a side face of the depression.

17. The developing cartridge as set forth in claim 16, wherein the groove is formed so as to extend to an end face of the housing.

18. An air communication unit of a developing cartridge used with a rotary developing unit for rotating around a rotation shaft with a plurality of developing cartridges placed therein, thereby bringing the selected developing cartridge adjacent to a photoconductor drum in an image formation apparatus and moving toner in the developing cartridge to the photoconductor drum, the developing cartridge comprising:

a housing, which has a peripheral surface and two end faces of both sides of the peripheral surface; and a toner storage portion, which is formed in the housing for storing toner, wherein a communication hole is formed in the peripheral surface; and wherein the communication hole is sealed by a sticker which has minute holes for allowing air to flow and preventing the toner from passing through.

19. The air communication unit of the developing cartridge as set forth in claim 18, wherein a label is put on the sticker; and wherein the label is formed with an air hole for allowing air to flow.

20. The air communication unit of the developing cartridge as set forth in claim 18, wherein a label is put on the housing so as to have a gap between the label and the sticker; and wherein a communication passage which communicates the gap to an atmosphere is formed.

21. The air communication unit of the developing cartridge as set forth in claim 20, further comprising gap securing means which secures the gap between the sticker and the label.

22. A toner cartridge, comprising:

a housing, which has a peripheral surface and two end faces formed on both sides of the peripheral surface, a toner containing space surrounded by the peripheral surface and two end faces which contains toner therein, and the housing having a communication hole which communicates the toner containing space with an exterior; and a sticker, which is arranged so as to seal the communication hole, wherein the sticker has minute holes for allowing air to flow and preventing the toner from passing through, wherein the peripheral surface of the housing has an upper face and a lower face; and wherein the communication hole is formed in both of the upper face and the lower face.

* * * * *